US009376793B2

(12) United States Patent
DelGigante et al.

(10) Patent No.: US 9,376,793 B2
(45) Date of Patent: Jun. 28, 2016

(54) SINGLE USE, FOLDABLE DISPENSER FOR AN ADHESIVE LAVATORY TREATMENT COMPOSITION

(71) Applicant: Reckitt Benckiser LLC, Parsippany, NJ (US)

(72) Inventors: Jesse DelGigante, Beaconsfield (GB); Geoff Woo, Montvale, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 0 days.

(21) Appl. No.: 14/434,984

(22) PCT Filed: Sep. 25, 2013

(86) PCT No.: PCT/GB2013/052502

§ 371 (c)(1),
(2) Date: Apr. 10, 2015

(87) PCT Pub. No.: WO2014/072677

PCT Pub. Date: May 15, 2014

(65) Prior Publication Data

US 2015/0259895 A1 Sep. 17, 2015

Related U.S. Application Data

(60) Provisional application No. 61/724,738, filed on Nov. 9, 2012.

(51) Int. Cl.
*E03D 9/02* (2006.01)
*E03D 9/03* (2006.01)

(52) U.S. Cl.
CPC ..... *E03D 9/032* (2013.01); *E03D 2009/026* (2013.01)

(58) Field of Classification Search
CPC ..... E03D 9/005
USPC ..... 4/222–233
See application file for complete search history.

(56) References Cited

U.S. PATENT DOCUMENTS

2012/0037301 A1 2/2012 Rice et al.

FOREIGN PATENT DOCUMENTS

| | | | |
|---|---|---|---|
| CH | 675140 | A5 | 8/1990 |
| DE | 2321641 | | 11/1974 |
| DE | 10222009 | A1 | 12/2003 |
| DE | 102004034024 | A1 | 2/2006 |
| EP | 0773330 | A1 | 5/1997 |
| EP | 2085213 | A1 | 8/2009 |

OTHER PUBLICATIONS

International Search report and Written Opinion of the International Searching Authority for PCT/GB2013/052502 dated Dec. 5, 2013.

*Primary Examiner* — Lori Baker
(74) *Attorney, Agent, or Firm* — Norris McLaughlin & Marcus PA

(57) ABSTRACT

Disclosed is a single use foldable dispenser for storing, and dispensing a quantity of an adhesive laboratory treatment composition.

8 Claims, 9 Drawing Sheets

SINGLE USE, FOLDABLE DISPENSER FOR AN ADHESIVE LAVATORY TREATMENT COMPOSITION

This is an application filed under 35 USC 371 of PCT/GB2013/052502, which claims priority to U.S. 61/724,738 filed 9 Nov. 2012, the entire contents of the foregoing applications being herein incorporated by reference.

The present invention relates to a single use, foldable dispenser for an adhesive laboratory treatment composition.

The prior art has suggested certain dispensers which may be used to dispense a dose or portion of an adhesive product onto a surface.

In US 2012/0037301 A1 is disclosed an applicator for a self-adhesive material. The applicator includes an outer surface, and an inner surface which defines a void adapted to receive a self-adhesive material. The applicator may be used to deposit the self-adhesive material onto a surface.

WO 2012/017276 (PCT/IB2011/001160) discloses sanitary cleaning agents which are covered by a water soluble film.

EP 2141221 discloses an applicator device for an adhesive detergent product, whereby the device may be used to apply the adhesive detergent products to a vertical wall, such as the sidewall of a toilet bowl.

While the prior art suggests certain embodiments of applicators, useful with specific adhesive material compositions, these devices are not without their shortcomings. For example, the device disclosed in US 2012/0037301 A1 is relatively bulky, and rigid, requiring increased amount of storage volume prior to its use. Furthermore, the amount of materials, presumably thermoplastic polymeric materials which are used to form the applicator may be considered excessive for use in a single-use type device. The applicator device disclosed in EP 2141221 is effective, but requires that the fingers of a human user utilizing the applicator device to deliver a quantity of the adhesive detergent product to the interior sidewall of a toilet bowl come in near proximity to, and may come into contact with this interior sidewall. Such is a very unfavorable manner of applying such a product from a consumer standpoint, who desirably avoids physical contact with the interior sidewall of a toilet bowl. It is to these, as well as further shortcomings in the art to which the present invention is directed.

In a broad aspect the present invention provides a single use, foldable dispenser for an adhesive lavatory treatment composition.

Figure 1:
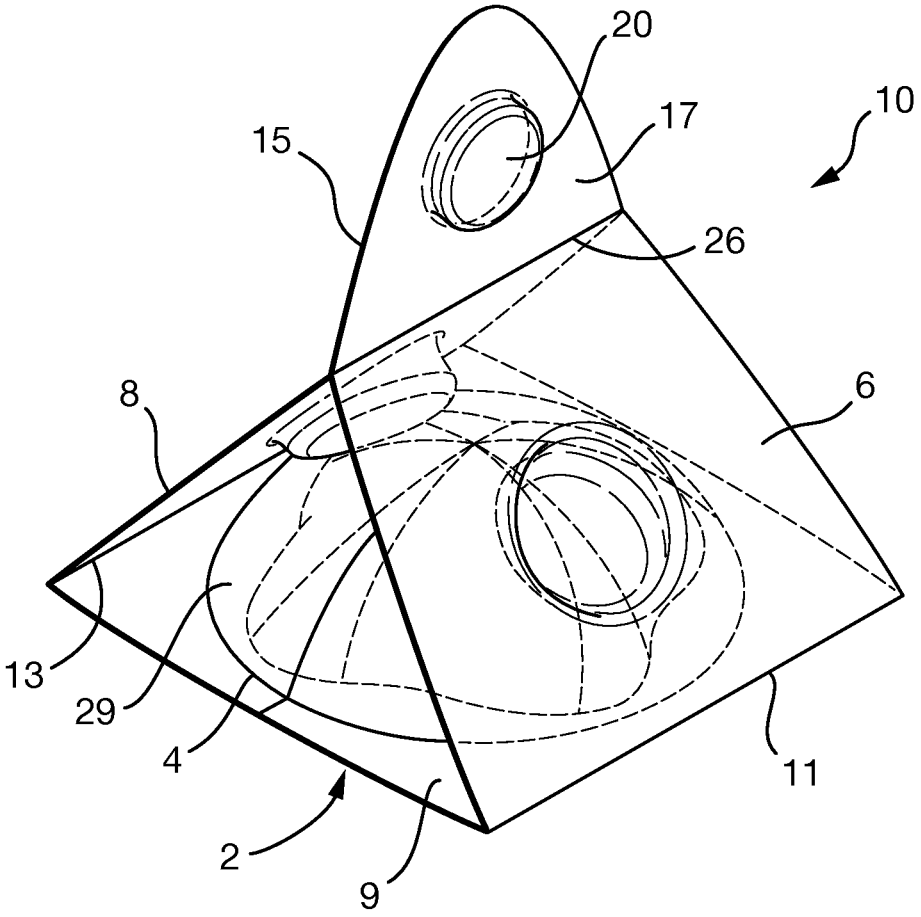
FIG. 1 depicts an embodiment of a single use, foldable dispenser of the invention.

In a first preferred embodiment, the single use, foldable dispenser includes a generally centrally located base which includes a cavity, from which base extend outwardly and in opposite directions one or more foldable arms which may be hinged about the base portion such that in an initial configuration, one or both of the arms are generally coplanar with a flat surface of the base and/or the opening of the cavity, and in a further configuration both of the arms are folded rearwardly of the base and cavity so that at least a portion of each of the arms extends above the cavity. In particular preferred embodiments, two rearwardly folded arms contact each other, and preferably come into an interfacial laminar contact, or optionally into an interlocking contact by virtue of one or more interlocking means which may be provided with the dispenser, and/or which are incorporated into the construction of one or both of the arms.

In accordance with a second embodiment, optionally but preferably, the single use, foldable dispenser additionally includes as a release means, a release film which extends into the cavity, and in which at least part of the release film may be temporarily, or permanently affixed to a part of the dispenser.

In accordance with a third embodiment, optionally but preferably, the single use, foldable dispenser additionally includes as a release means, a release material which extends into or is contained within the cavity, and which forms a barrier between the contents of the cavity of the dispenser and the dispenser itself.

In a fourth preferred embodiment, optionally but preferably the single use, foldable dispenser additionally includes a cover film or other cover means which spans across the open end of the cavity and may be removed therefrom prior to dispensing of any material contained within the cavity.

In a fifth preferred embodiment of the single use, foldable dispenser, optionally but preferably, at least one, but preferably both of the arms are also sufficiently flexible in a forward direction such that when folded forwardly at least a part of at least one of the arms may be used to form a cover means over the open end of the cavity of the base portion, and which arm may be removed prior to dispensing of any material contained within the cavity.

According to a sixth preferred embodiment, there is provided a single use, foldable dispenser, which includes a base portion which comprises a cavity, and a single foldable arm which may be hinged around the base. Preferably, in an initial configuration the arm is folded forwardly such that at least part of the arm is used to form a cover means over the open end of the cavity of the base portion, and in a further configuration, the arm is folded away from the open end of the cavity of the base portion, preferably such that the arm is generally coplanar with the base portion.

In a further embodiment there is provided a single use, foldable dispenser according to any of the preceding embodiments disclosed herein, or otherwise described in the specification, which contains a quantity of an adhesive lavatory treatment composition or an adhesive detergent product which is preferably a viscous paste or gel product.

In a still further embodiment there is provided a method of making a single use, foldable dispenser adapted to be used for storing, and dispensing a quantity of an adhesive lavatory treatment composition.

In a yet further embodiment of the invention there is provided a method of applying an adhesive lavatory treatment composition to a surface from a single use, foldable dispenser according to any of the preceding embodiments disclosed herein, or otherwise described in the specification.

In a further embodiment there is provided as a vendible product a single use, foldable dispenser containing a quantity of an adhesive lavatory treatment composition.

These and further embodiments of the invention will be more apparent from the following specification and drawings which illustrate certain embodiments of the invention.

The dispensers of the invention may be used to contain and to delivery a quantity of an adhesive treatment composition to a surface. In preferred embodiments the adhesive treatment composition is an adhesive lavatory treatment composition. Examples of adhesive treatment compositions which may be contained and delivered to a surface from the dispensers of the invention include compositions which are known to the art. Such include (but are not limited to) those disclosed in the following published patent documents: EP 0864637; EP 108699; EP 1086204; EP 1318191; AU 2001285865; EP 1817399; EP 1953215; EP 2250245; EP 2275524; DE 1020080192; US 2011/0002871 A1; US 2011/0142784 A1; US 2011/0142785 A1; EP 2121893; EP 2363457; EP 2167627; EP 2387606; EP 2419349; EP 2445806; U.S. Pat. No. 7,919,447; US 2009/0215909, US 2009/0325839; US 2010/0325839; US 2010/0216685; US 2011/0017406; US 2011/0033224; US 2012/0108490; US 2009/0215909; EP 2254980; EP 2387605; U.S. Pat. No. 8,143,205; U.S. Pat. No. 8,143,206; US 2012/0232165; US 2012/0232170; EP 1978080; EP 2141221; DE 19910788; U.S. Pat. No. 6,521,578; EP 2082020; US 2010/130400; US 2010/162474; U.S. Pat. No. 8,076,278; US 2010/130399; U.S. Pat. No. 6,336,977; US 2008/057020; US 2008/058239; US 2008/058240; US 2008/058241; US 2008/099041; EP 2316914; EP 1625195; EP 2336290; EP 2159276; EP 2328997; WO 2012/017276; US 2012/0037301; WO 2012/013490; EP 1418225; WO 2012/052379; EP 2473421; WO 2012/017277; WO 2012/017278; EP 2281756 and US 2012/0178824.

In certain particularly preferred embodiments the dispensers of the invention may be used to contain and to delivery a quantity of a self-adhesive lavatory treatment composition which comprises (or, consists essentially of, or consists of):

an adhesion promoter based on a fatty alcohol polyglycol ether as may be represented by the following structural formula (I):

$$R-O-\left[CH_2-CH_2-O\right]_n-H \quad (I)$$

within which, R is an $C_{12}$-$C_{24}$ aliphatic mono- or poly-alkene moiety, and n has a value of from 1 to 30;

an organic solvent constituent, which is liquid at room temperature (20° C.);

a surfactant constituent;

water;

optionally a co-adhesion promoter constituent, preferably based on one or more oxyalkylenated compounds;

and, further optionally one or more further optional constituents which may impart a further aesthetic or technical benefit to the said self-adhesive lavatory treatment compositions;

wherein in use, the said self-adhesive lavatory treatment compositions may be applied and adhered to a dry or wetted ceramic surface, especially the interior sidewall in a toilet bowl or other lavatory appliance, and wherein the said self-adhesive lavatory treatment compositions is retained adhered to the said surface following a plurality of flushes of water impinging upon the adhered self-adhesive lavatory treatment compositions.

In said self-adhesive lavatory treatment composition the adhesion promoter is one or more fatty alcohol polyglycol ether, as may be represented by the following structural formula (I):

$$R-O-\left[CH_2-CH_2-O\right]_n-H \quad (I)$$

within which:

R is an $C_{12}$-$C_{24}$ aliphatic (poly)alkane moiety, and n has a value of from 1 to 30, but preferably n has a value of from 8 to 20, and most preferably has a value of from 10 to 20, inclusive.

Preferably R is a residue of a $C_{12}$-$C_{24}$ fatty alcohol having at least one unsaturated bond, viz., monounsaturation, but the residue of a $C_{12}$-$C_{24}$ fatty alcohol is preferably monounsaturated. While the residue of a $C_{12}$-$C_{24}$ fatty alcohol may have one or more branches, it is preferably linear. Mixtures or blends of two or more such fatty alcohol glycol ethers may also be used.

In preferred embodiments the adhesion promoter based on a fatty alcohol glycol ether, conforms to the foregoing structural formula and comprises one or more unsaturations within the midsection of the $C_{12}$-$C_{24}$ fatty alcohol, e.g, wherein the location of the at least one unsaturation (preferably a single unsaturation is present) is within the interior portion of the carbon molecules as measured from the midpoint of the $C_{12}$-$C_{24}$ aliphatic (poly)alkane moiety and extending outwardly therefrom from both sides from the central carbon(s) which is/are equidistant from the two most distal carbon atoms of the longest carbon chain in the $C_{12}$-$C_{24}$ aliphatic (poly)alkane moiety. Thus for example, if the R is a linear $C_{14}$ fatty alcohol, which is an even numbered fatty alcohol, then the central carbon(s) are the $C_7$ and $C_8$ carbons which are also at the midpoint as measured from the distal, $C_1$ and $C_{14}$ carbons of theis fatty alcohol. Where, for example R is a odd numbered fatty alcohol, e.g. where R is a $C_{15}$ fatty alcohol, then the central carbon is the $C_8$ alcohol which is at the midpoint, as being equidistant from both the $C_1$ and $C_{15}$ carbons of the fatty alcohol. The midpoint carbon(s) may also be identified by the following equation:

$$N/2=\text{midpoint carbon(s)}$$

wherein:

N is the number of carbon atoms in the longest carbon chain in the $C_{12}$-$C_{24}$ aliphatic (poly)alkane moiety, corresponding to R in the foregoing structural formula. Wherein "N" is an even number then the foregoing equation will yield a value with no decimal remainder (e.g., for a $C_{14}$ aliphatic (poly)alkane moiety, N=14, and thus N/2=7), then the midpoint carbons are the N/2 carbon, and the adjacent (N/2)+1 carbon. Such corresponds to the $7^{th}$ and $8^{th}$ carbons in the $C_{14}$ aliphatic (poly)alkane moiety. Wherein "N" is an odd number then the foregoing equation will yield a value with a "0.5" decimal remainder, (e.g., for a $C_{15}$ aliphatic (poly)alkane moiety, N=15, and thus N/2=7.5), then the midpoint carbons is (N/2)+0.5 carbon. Such corresponds to the $8^{th}$ carbon atom in the $C_{15}$ aliphatic (poly)alkane moiety.

Preferably the one or more unsaturations present with the $C_{12}$-$C_{24}$ aliphatic (poly)alkane moiety are between adjacent carbon atoms which are between the (N−N+2) carbon atoms and the (N−2) carbon atoms, and in order of increasing preference are: between the (N−N+4) carbon atoms and the (N−4) carbon atoms, and between the (N−N+5) carbon atoms and the (N−5) carbon atoms of the $C_{12}$-$C_{24}$ aliphatic (poly)alkane moiety.

Preferably the one or more unsaturations present with the $C_{12}$-$C_{24}$ aliphatic (poly)alkane moiety are between adjacent carbons which are within four carbons adjacent to one or both of the midpoint carbon(s), preferably are within three carbons adjacent to the one or both of the midpoint carbon(s), and especially preferably is/are between adjacent carbon atoms at least one of which is the midpoint carbon(s) in the longest carbon chain in the $C_{12}$-$C_{24}$ aliphatic (poly)alkane moiety.

Particularly preferred fatty alcohol glycol ethers of the foregoing structural formula (I) include those which have two or less unsaturations in the R residue, and particularly preferred are those which have a single unsaturation in the R residue.

In certain preferred embodiments the R residue of the fatty alcohol polyglycol ether of the foregoing structural formula (I) is derived from a monounsaturated fatty alcohol which may be represented by the following formula (II):

$$CH_3(CH_2)_xCH{=}CH(CH_2)_y{-}CH_2OH \quad (II)$$

in which each of x and y are integers which have a value in the range of 6-32, preferably in the range of 8-18, and further preferably the value of x:y are within the respective ratios of from 0.5:1-1:0.5 preferably 0.75:1-1:0.75, and especially preferably about 1:1.

Preferred fatty alcohol glycol ethers of the foregoing structural formula (I) include those which are presently commercially available in the Genapol® "O" series of nonionic surfactants, and in which the fatty alcohol glycol ethers include a residue based on an oleyl alcohol which has a structure: $CH_3(CH_2)_7{-}CH{=}CH{-}(CH_2)_8{-}OH$, and contains a single monounsaturation at or near the midpoint from the terminal ends of the fatty alcohol. Further preferred fatty alcohol glycol ethers of the foregoing structural formula (I) include those which are presently commercially available in the Genapol® "U" series of nonionic surfactants.

Advantageously the adhesion promoter based on a fatty alcohol polyglycol ether is present in the compositions in amount of from about 10% wt. to about 50% wt., preferably from about 20% wt. to about 45% wt. based on the total weight of the self-adhesive lavatory treatment compositions of which they form a part.

In the particularly preferred self-adhesive lavatory treatment compositions, the organic solvent constituent, which is liquid at room temperature (20° C.), comprises one or more organic solvents as the organic solvent constituent, but in preferred embodiments is a single organic solvent. By way of non-limiting example exemplary useful organic solvents which are liquid at room temperature (20° C.) and which may be included in the inventive compositions are those which are at least partially water-miscible such as alcohols (e.g., low molecular weight alcohols, such as, for example, ethanol, propanol, isopropanol, and the like), glycols (such as, for example, ethylene glycol, propylene glycol, hexylene glycol, and the like), water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethylene glycol or propylene glycol (e.g. propylene glycol monomethyl ether acetate), and mixtures thereof. Glycol ethers having the general structure $R_a$—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Polyhydroxy organic solvents, viz, those having two or more —OH moieties are in certain cases, preferred for use.

The organic solvent may also include one or more further liquids such as glycerine and paraffin oil, as well as petroleum distillates and/or petroleum products, paraffinic oils usually based on n-alkanes, naphthenic oils usually based on cycloalkanes, aromatic oils such as those based on aromatic hydrocarbons, mineral oil, as well as technical grade mixtures of hydrocarbons may be used as or in the organic solvent. Examples of the latter include paraffinic hydrocarbons including both linear and branched paraffinic hydrocarbons; the former are commercially available as NORPAR solvents (ex. ExxonMobil Corp.) while the latter are available as ISOPAR solvents (ex. ExxonMobil Corp.) Mixtures of branched hydrocarbons especially as isoparaffins form are also contemplated to be useful.

In certain preferred embodiments the organic solvent constituent necessarily includes at least one glycol or glycol ether, and further includes one or both of glycerine and/or mineral oil. When such at least one glycol or glycol ether is present in conjunction with one or both of glycerine and/or mineral oil, preferably the mass of the at least one glycol or glycol ether is at least about three times, preferably at least about four times that of the total mass of the glycerine and/or a mineral oil present.

In certain preferred embodiments the organic solvent constituent consists essentially of, yet more preferably consists of, at least one polyhydroxy organic solvents, e.g, a glycol or glycol ether, and further includes one or both of glycerine and/or mineral oil.

In further, certain preferred embodiments the organic solvent constituent consists essentially of, yet more preferably consists of, at least one glycol or glycol ether, and mineral oil.

In further, certain preferred embodiments the organic solvent constituent consists essentially of, yet more preferably consists of, at least one glycol or glycol ether, and both glycerine and mineral oil.

The organic solvent constituent comprises 1-25% wt. of the inventive compositions. Preferably, in order of increasing preference the organic solvent constituent is present in an amount of at least about 1%, 1.5, 2%, 2.5%, 3% wt. of the inventive composition of which they form a part. Preferably, in order of increasing preference the organic solvent constituent comprises not more than about 25%, 20%, 18%, 17%, 16%, 15%, 14%, 13%, 12%, 11%, 10%, 9.5%, 9%, 8.5%, 8%, 7.7%, 7%, 6.5%, 6%, 5.5% and 5% wt. of the inventive composition of which they form a part. Particularly preferred amounts of the organic solvent constituent are recited in one or more of the Examples, with preferred ranges of the organic solvent constituent also disclosed in the Examples.

In certain preferred embodiments:

(a) the ratio (in % wt.) of polyhydroxy organic solvent: other solvents of the organic solvent constituent is in the range of about 4-12:1, preferably about 4.5-10:1, and especially preferably 4.5-8.5:1; and/or, (b) the ratio (in % wt.) of polyhydroxy organic solvent: mineral oil is in the range of about 5-20:1, more preferably about 7:18:1; and/or, (c) the ratios (in % wt.) of water:organic solvent constituent is in the range of about 5-20:1, more preferably about 6-16:1; and/or, (d) the ratios (in % wt.) of water:polyhydroxy organic solvent constituent is in the range of about 5-25:1, preferably about 7-25:1.

Particular and preferred specific ratios of (a), (b), (c) and/or (d) are disclosed with reference to one or more of the examples.

In certain particularly preferred embodiments the conditions outlined of at least two of, preferably at least three of, and particularly preferably the conditions outlined in all four of (a), (b), (c) and (d) are met/satisfied.

These particularly preferred self-adhesive lavatory treatment composition also comprise a surfactant constituent, which is distinguishable from the adhesion promoter constituent. As the surfactant constituent may be used one or more anionic, cationic, nonionic, amphoteric or zwitterionic surfactant compounds. The surfactant constituent comprises from about 0.1% wt. to about 35% wt., preferably from about 5% wt. to about 25% wt. based on the total weight of the self-adhesive lavatory treatment compositions of which they form a part. In certain preferred embodiments one or more anionic, cationic, nonionic, amphoteric or zwitterionic surfactant compounds are expressly excluded.

These particularly preferred self-adhesive lavatory treatment compositions also comprise water which comprises between about 25% wt. and 75% wt., preferably about 30% wt. and about 60% wt. of the self-adhesive lavatory treatment compositions of the invention. Preferably, the amount of water added is advantageously sufficient to ensure that the resultant self-adhesive lavatory treatment compositions are "ringing gels". These ringing gels do not appreciably sag or run when formed, and are amorphous, non-crystalline materials which exhibit a ringing phenomena when they are excited by mechanical vibrations. Such ringing gels are believed to be microemulsion gels which are formed by the incorporation of the dispersed organic solvent constituent within the water, adhesion promoter constituent and the surfactant constituent which form the bulk of the particularly preferred self-adhesive lavatory treatment compositions. Such ringing gels form within 48 hours of being mixed, preferably within 24 hours of being mixed, and in certain preferred embodiments the ringing gels form within 1 hour of being mixed. The inventive compositions preferably and in some embodiments necessarily further comprise a co-adhesion promoter constituent based on one or more oxyalkylenated compounds. These oxyalkylenated compound(s) typically comprise ethylene oxide groups ("EO") (oxyethylenated compounds), or propylene oxide groups ("PO") (oxypropylenated compounds) or both ("EO/PO") (oxyethylenated/oxypropylenated compounds). Of course, a plurality of oxyalkylenated compound(s) may be used in the primary adhesion promoter constituent of the adhesive lavatory treatment compositions.

Exemplary suitable oxyalkylenated compounds may be selected from: polyethylene glycols, polyethylene glycol esters and/or polypropylene glycol esters, polyethylene glycol ethers and/or polypropylene glycol ethers, alkoxylated acyl derivatives, ethoxylated acyl polyol derivatives, oxyalkylenated (especially) oxyethylenated triesters of glycerol and of fatty acids, and mixtures thereof.

Non-limiting examples of suitable polyethylene glycols which may be used in the composition of the invention include ethylene oxide polycondensates having a number of ethylene oxide (EO) units of greater than 10, and preferably greater than about 20. The ethylene oxide number preferably range from about 10 to about 50,000 and preferably from about 20 to about 10,000. Non-limiting examples of such polyethylene glycols include polyethylene glycol comprising 7,000 EO (CTFA name: PEG-7M), polyethylene glycol comprising 75 EO (CTFA name: PEG-75), polyethylene glycol comprising 20,000 EO (CTFA name: PEG-20M), and polyethylene glycol comprising 150 EO (CTFA name: PEG-150).

Non-limiting examples of suitable polyethylene glycol esters and/or polypropylene glycol esters include condensates of polyethylene glycol and/or polypropylene glycol with one or more fatty acids. These compounds typically have the formula:

$$RCOO-[CH_2CH_2O]_a-[CH_2CH_2CH_2O]_b-R'$$

wherein:

each of R and R' independently represent: hydrogen or a saturated or unsaturated, linear or branched, hydroxylated or non-hydroxylated alkyl chain containing from 1 to 30 carbon atoms, preferably from 12 to 22 carbon atoms, or an aryl chain, with the proviso that R and R' are not simultaneously hydrogen, a=0-300 b=0-300, and preferably a+b is greater than or equal to 10, preferably at least 20, still more preferably at least 30.

Non-limiting examples of polyethylene glycol acid esters and/or polypropylene glycol acid esters include polyethylene glycol distearate (150 EO), PEG-150 dibehenate, polyethylene glycol palmitostearate (120 EO), the copolymer of polyethylene glycol (30 EO) and of 12-hydroxystearic acid, and polyethylene glycol stearate (40 EO). Examples of compounds according to the foregoing formula wherein R and R' are both hydrogen, such compound may be polyoxyethylene polyoxypropylene copolymers.

Non-limiting examples of polyethylene glycol ethers and/or polypropylene glycol ethers include condensates of polyethylene glycol and/or polypropylene glycol with one or more fatty alcohols. These compounds typically conform to the formula:

$$R-[CH_2CH_2O]_a-[CH_2CH_2CH_2O]_b-R'$$

wherein:

each of R and R' represent, independently of each other, hydrogen or a saturated or unsaturated, linear or branched, hydroxylated or non-hydroxylated alkyl chain containing from 1 to 30 carbon atoms, preferably from 12 to 22 carbon atoms, or an aryl chain, with the proviso that R and R' are not simultaneously hydrogen.

a=0-300 b=0-300, and preferably a+b is greater than or equal to 10, preferably at least 20, still more preferably at least 30.

Non-limiting examples of such polyethylene glycol ethers include oxyethylenated (30 EO) cetyl alcohol, oxyethylenated (15 EO) oleyl alcohol, oxyethylenated (50 EO) oleyl alcohol, oxyethylenated (10 EO) behenyl alcohol, oxyethylenated (30 EO) behenyl alcohol, oxyethylenated (12 EO) lauryl alcohol, oxyethylenated (23 EO) lauryl alcohol, oxyethylenated (20 EO) 2-octyldodecyl alcohol, oxyethylenated (20 EO) isocetyl alcohol, oxyethylenated (10 EO) oleyl alcohol, oxyethylenated (20 EO) oleyl alcohol, oxyethylenated (100 EO) stearyl alcohol, and oxyethylenated (21 EO) stearyl alcohol.

Non-limiting examples of polyethylene glycol/polypropylene glycol ethers in particular, include oxyethylenated (5 EO) oxypropylenated (5 PO) lauryl alcohol, oxypropylenated (3 PO) myristyl alcohol, oxyethylenated (20 EO) oxypropylenated (5 PO) cetyl alcohol, oxyethylenated (26 EO) oxypropylenated (26 PO) butyl alcohol, oxyethylenated (26 EO) oxypropylenated (26 PO) butyl alcohol, oxyethylenated (30 EO) oxypropylenated (6 PO) decyltetradecanol, and oxyethylenated (25 EO) oxypropylenated (25 PO) lauryl alcohol.

Non-limiting examples of ethoxylated alkyl or aryl derivatives of polyol include oxyethylenated derivatives of fatty acid esters or of fatty alcohol ethers and of a polyol such as glycerol, sorbitol, glucose or pentaerythritol. Suitable derivatives of this type include, for example, oxyethylenated (78 EO) glyceryl cocoate, oxyethylenated (120 EO) methylglucose dioleate, oxyethylenated (40 EO) sorbitan septaoleate, oxyethylenated (10 EO) polyglyceryl (2 mol of glycerol) laurate, oxyethylenated (60 EO) glyceryl isostearate, oxyethylenated (20 EO) glyceryl monostearate, oxyethylenated (200 EO) glyceryl stearate, and oxyethylenated (150 EO) pentaerythrityl tetrastearate, such as the product sold under the name Crothix™ (ex. Croda, Inc.)

Non-limiting examples of suitable oxyalkylenated glyceryl triesters of fatty acids include, for example, oxyethylenated (6 EO) caprylic/capric acid glycerides, and oxyethylenated (50 EO) olive oil.

Particularly preferred for use in the co-adhesion promoter constituent are compounds according to the structure:

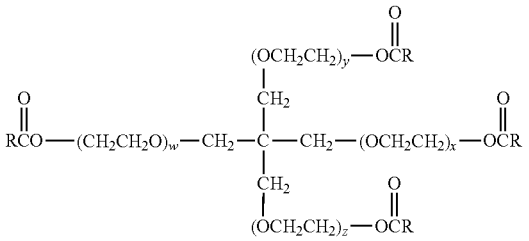

wherein,

R is a fatty acid moiety, preferably a stearic fatty acid moiety, and the sum of w+x+y+z is in the range of 50-1500, preferably in the range of 70-500, more preferably in the range of about 100-350 and especially preferably about 150.

A particularly preferred primary adhesion promoter constituent is a material presently commercially available under the tradename Crothix (ex. Croda, Inc.).

Further particularly preferred co-adhesion promoters include high molecular weight water-soluble poly(ethylene oxide) polymers, which desirably have molecular weights (weight average) in the range from about 100,000 to about 8,000,000. Such high molecular weight water-soluble poly (ethylene oxide) polymers are presently commercially available as Polyox resins (ex. Dow Chem. Co.).

In certain embodiments, the co-adhesion promoter constituent is pasty or is solid at room temperature (20° C.).

Mixtures of two or more of the foregoing materials and/or compounds may be used to provide the co-adhesion promoter constituent. Alternatively a single of the foregoing materials and/or compounds can be used to provide the co-adhesion promoter constituent.

In certain preferred embodiments, one or more of the foregoing co-adhesion promoters are expressly excluded from the adhesive lavatory treatment compositions.

In further preferred embodiments a co-adhesion promoter is necessarily present in the adhesive lavatory treatment compositions.

When present, the co-adhesion promoter constituent comprises from about 0.001% wt.-5% wt., preferably about 0.05% wt.-2.5% wt., based on the total weight of the inventive composition of which it forms a part.

In embodiments of the invention, wherein both a primary adhesion promoter and a co-adhesion promoter are concurrently present, preferably the weight ratio of the former to the latter is at least about not more than 10:1, and especially preferably is not more than about 20:1

Such particularly preferred self-adhesive lavatory treatment compositions may comprise one or more further optional constituents which may impart a further aesthetic or technical benefit to the said self-adhesive lavatory treatment compositions. When present, such further optional constituents are generally present in a cumulative amount of less than about 25% wt. based on the total weight of the self-adhesive lavatory treatment compositions wherein one or more such further optional constituents may be present. By way of non-limiting example such further optional constituents include one or more of: coloring agents, fragrances and fragrance solubilizers, viscosity modifying agents, thickeners, bleaches, bleach releasing compounds, oxidizing agents, germicidal agents, pH adjusting agents and pH buffers including organic and inorganic salts as well as organic and inorganic acids, builders, chelating agents, opacifying agents, titanium dioxide, inert inorganic or organic fillers, visually discernible additive materials, hydrotropes, enzymes as well as other biologically active constituents, anti-oxidants, preservatives, and anti-corrosion agents, as well as other optional constituents known to the skilled artisan. When one or more of the optional constituents is added, i.e., fragrance and/or coloring agents, the esthetic and consumer appeal of the product is often favorably improved. The use and selection of these optional constituents should be based on imparting a desired additional aesthetic or technical benefit, as well as to ensure compatibility with the further constituents present in the inventive self-adhesive lavatory treatment compositions, especially such that the desirable self-adhesive properties of the self-adhesive lavatory treatment compositions are not deleteriously diminished.

Such particularly preferred self-adhesive lavatory treatment compositions of the invention are viscous or pasty, and may be characterized in having a viscosity in the range of from about 150,000 cP to about 7,000,000 cP, but preferably from about 200,000 to about 5,000,000.

Non-limiting examples of particularly preferred self-adhesive lavatory treatment compositions include those disclosed on the following Table 1:

TABLE 1

| | | E1 | E2 | E3 | E4 | E5 | E6 | E7 |
|---|---|---|---|---|---|---|---|---|
| Part A | Genapol ® O 200 | 30 | 28 | 26 | 30 | 30 | 30 | 20 |
| | sodium lauryl ether sulfate, 3EO (70%) | 18 | 18 | 14 | 18 | 18 | 18 | 14 |
| | PEG 4000 | — | — | — | — | — | — | — |
| | mineral oil (light) | 0.5 | 0.5 | 0.5 | 0.5 | 0.5 | 0.5 | 1.0 |
| | glycerin | 0.5 | | 0.5 | 0.5 | 0.5 | 0.5 | 0.5 |
| | propylene glycol | 3.0 | 3.0 | 2.0 | 5.0 | 5.0 | 5.0 | 7.0 |
| Part B | propylene glycol | 2.0 | — | 5.0 | — | 3.0 | 3.0 | — |
| | fragrance #1 | 3.0 | — | — | — | — | — | — |
| | fragrance #2 | — | 4.0 | 4.0 | — | — | — | — |
| | colorant #1 | — | 0.004125 | 0.004125 | — | — | — | — |
| | colorant #2 | — | 0.002000 | 0.002000 | — | — | — | — |
| | (propylene glycol from colorants #1, #2) | — | 0.606375 | 0.606375 | — | — | — | — |
| Part C | water (supplied to q.s.) | 43.0 | 45.8 | 47.3 | 46.0 | 43.0 | 43.0 | 57.5 |
| | TOTAL (% wt.): | 100 | 100 | 100 | 100 | 100 | 100 | 100 |
| | total % wt. propylene glycol from Part A and Part B | 5.00 | 3.60 | 7.60 | 5.00 | 8.00 | 8.00 | 7.00 |
| | ratio (% wt.) of propylene glycol:other organic solvents | 5:1 | 7.212:1 | 7.60:1 | 5:1 | 8:1 | 8:1 | 4.66:1 |
| | ratio (% wt.) of propylene glycol:mineral oil | 10:1 | 7.2:1 | 15.2:1 | 10:1 | 16:1 | 16:1 | 7:1 |
| | ratio (% wt.) of water:organic solvents | 10.75 | 13.11 | 15.79 | 7.66 | 7.16 | 7.16 | 6.76 |
| | ratio (% wt.) of water:propylene glycol and mineral oil | 12.28 | 13.11 | 18.95 | 8.36 | 7.81 | 7.81 | 7.18 |
| | ratio (% wt.) of water:propylene glycol | 14.33 | 15.29 | 23.69 | 9.2 | 8.6 | 8.6 | 8.2 |
| | onset of ringing gel properties (in hours) after initial formation of gel | 48+ | 48 | 24 | 24 | 24 | 24 | 12 to 18 |
| | lifespan (flush) testing (days) | NA | NA | 45+ | NA | NA | NA | NA |

| | | E8 | E9 | E10 | E11 | E12 |
|---|---|---|---|---|---|---|
| Part A | Genapol ® O 200 | 25 | 25 | 5 | 25 | 5 |
| | Genapol ® U 300 | — | 5 | 25 | — | 25 |
| | Praepagen HEQ (50%) | 5 | 5 | 5 | — | 5 |
| | Crothix PA | — | — | — | — | 1 |
| | mineral oil (light) | 2 | 2 | 2 | 4 | 2 |
| | glycerin | 8 | 8 | 8 | 8 | — |
| Part B | fragrance #1 | 4 | 4 | 4 | 4 | 4 |
| | colorant #1 | 0.001 | 0.001 | 0.001 | 0.001 | 0.001 |
| | (propylene glycol from colorants #1) | | | | | |
| Part C | betaine surfactant (30%) | — | — | — | 25 | — |
| | water (supplied to q.s.) | 55.99 | 50.99 | 50.99 | 33.99 | 49.99 |
| | TOTAL (% wt.): | 100 | 100 | 100 | 100 | 100 |
| | total % wt. propylene glycol from Part A and Part B | NA | NA | NA | NA | NA |
| | ratio (% wt.) of propylene glycol:other organic solvents | | | | | |
| | ratio (% wt.) of propylene glycol:mineral oil | | | | | |
| | ratio (% wt.) of water:organic solvents | | | | | |
| | ratio (% wt.) of water:propylene glycol and mineral oil | | | | | |
| | ratio (% wt.) of water:propylene glycol | | | | | |
| | onset of ringing gel properties (in hours) after initial formation of gel | | | | | |
| | lifespan (flush) testing (days) | | | | | |

The identity of the constituents of Table 1 are disclosed on the following Table 2. As noted, unless otherwise indicated the constituents were provided as "100% wt. actives".

TABLE 2

| | |
|---|---|
| Genapol ® O 200 | oleyl alcohol polyglycol ether, 20 mols (avg) ethoxylation, (100% wt. actives) (ex. Clariant) |
| Genapol ® U 300 | fatty alcohol polyglycol ether, (ex. Clariant) |
| sodium lauryl ether sulfate, 3EO (70%) | sodium lauryl ether sulfate, 3 mols (avg) ethoxylation, (ex. Rokita) (70% wt. actives) |
| PEG 4000 | polyethylene glycol, (weight average) M.W. 4000, (100% wt. actives) |
| Praepagen HEQ | alkyl hydroxyethyl dimethyl ammonium chloride (50% wt. actives) (ex. Clariant) |

TABLE 2-continued

| | |
|---|---|
| betaine surfactant (30%) | betaine surfactant, supplied as AMPHOTENSID B4 (ex. Zschimmer & Schwartz Italiana S.p.A) (30% wt. actives) |
| mineral oil (light) | technical grade light mineral oil (100% actives) (organic solvent) |
| glycerine | technical grade light mineral oil (100% actives) (organic solvent) |
| propylene glycol | technical grade supplied as (100% actives) (ex. DOW Chem. Co.) (organic solvent) |
| fragrance #1 | proprietary fragrance material |
| fragrance #2 | proprietary fragrance material |
| colorant #1 | pigment/dye (1 part pigment/dye dispersed in 99 parts of propylene glycol) |

TABLE 2-continued

| | |
|---|---|
| colorant #2 | pigment/dye (1 part pigment/dye dispersed in 99 parts of propylene glycol) |
| deioinized water | deionized water, supplied in 'quantum sufficient' (100% wt. actives) |

Samples of the compositions as described above on Table 1 formed "ringing gels" which were self-supporting, viz., and did not sag or run under their own weight. The compositions of Table 1 were formed by forming a first premixture of the constituents on Table 1 as "Part A" typically by combining and mixing the constituents at an elevated temperature (e.g., 50° C.-85° C.), forming a second premixture of the constituents on Table 1 as "Part B" by combining and mixing the constituents at an elevated temperature (e.g., 50° C.-85° C.), combining the first and second premixtures to form a homogenous mixture which was then combined with the water, optionally with any remaining constituents (e.g., betaine surfactant) disclosed on Table 1 as "Part C"., to form the compositions of Table 1.

The dispensers of the invention may be used to store, contain and to dispense or deliver a mass of an adhesive treatment composition preferably a self-adhesive lavatory treatment composition to a surface, such as a horizontal, vertical or inclined lavatory surface, which surfaces may be subjected to sprayed or flushed water on an intermittent or periodic basis. In a preferred embodiment such surfaces include those of environments and lavatory appliances which are periodically rinsed with water, e.g, sinks, bathtubs, shower stalls and other bathing or washing enclosures, as well as those which through which water is flushed, e.g., toilets, bidets, urinals, and the like.

While it is naturally understood that the operating parameters of lavatory devices, e.g., toilets, vary considerably and that the range of compositions which are taught herein are also variable, preferably, once applied a mass (preferably between about 2 and about 10 grams, more preferably from about 3 to about 7 grams, and covering a surface area of approximately about 1 to about 10 $cm^2$) of an self-adhesive lavatory treatment composition is applied from a dispenser according to the invention is retained in the hard surface for at least 5, and in order of increasing preference, at least 10, 15, 20, 25, 30, 35, 40, 45, 50, 55, 60, 65, 70, 75 and 80 flushes, or until the mass of the of the self-adhesive lavatory treatment compositions is eroded by the flushing water of the lavatory device.

The dispensers of the invention may be formed of any suitable material of construction. Preferred materials include those which are water impervious or include a water impervious layer or coating. Particularly preferred materials are also those which additionally have good vapor barrier properties such that an adhesive lavatory treatment composition stored within the cavity of the dispenser does not unduly degrade or dry out while being stored prior to use as an applicator for the adhesive lavatory treatment composition onto a surface. Non-limiting examples of suitable materials include polymers, particularly synthetic thermoplastic or thermosetting polymers, including but not limited to: polyamides (e.g., Nylon), polyolefins (e.g., polypropylene, polyethylene, HMWPE, LDPE) as well as polyalkyleneterephalates (i.e., polyethylene terephthalate, polybutylene terephthalate), polystyrenes, polysulfones, polycarbonates as well as copolymers formed from monomers of one or more of the foregoing being several nonlimiting examples of useful synthetic polymers. Advantageously such polymeric materials include those which may be formed into dispensing devices such as by stamping, injection molding, vacuum molding, or other thermoforming or thermosetting processes wherein the polymeric materials are advantageously also of relatively low cost. Further suitable materials include paper, metal foils, metalized polymers as well as laminated materials as well as coated materials which may include two or more dissimilar materials which are nonetheless formed into a multi-layer substrate which is used to form a dispensing device. Without limitation, such expressly include coated papers, multilayer polymer films, as well as paper/metal foil laminates and paper/plastic laminates. Indeed, coming into consideration are virtually all materials which can be formed into dispensing devices as disclosed in the specification, particularly those which can be formed into sheet materials, which thereafter can be fabricated into the dispensing devices.

Of particular utility are materials which are water dispersible, and/or which degrade when subjected for sufficient time to the environment of a sewer system or septic system. Such include water soluble or water dispersible polymeric materials, e.g., those containing or based on polyvinyl alcohols, as well as starch derivative polymers based on destructed starch, such as disclosed in U.S. Pat. No. 5,569,692. Destructured starch can be from any starch of natural or plant origin which is composed essentially of amylose and/or amylopectin. The starch can be extracted from any suitable plant, such as, for instance, potatoes, rice, maize, tapioca, or various cereals, such as rye, wheat, oats, etc. Chemically modified starches and starches of different genotypes can also be used, if desired. Additionally, ethoxy derivatives of starch, starch acetates, cationic starches, oxidized starches, cross-linked starches and the like may also be used. Such materials may be particularly useful as a coating or a layer of a coated or laminate structure, e.g., one or more paper layers which further include one or more such water dispersible or water degradable materials.

While the dispensers of the invention may be refilled and reused, in preferred embodiments the dispensers are of a single use type and are not refilled, but are subsequently discarded and/or recycled. Where the dispensers of are formed of water dispersible or biodegradable materials, e.g. those containing a content of paper and/or other materials which may dissolve or degrade in a sewer system or septic system, after the adhesive treatment composition is dispensed from the dispenser, the now empty dispensing device may be flushed down a toilet and after sufficient time and exposure in a sewer system or septic system, it breaks down or otherwise degrades.

Certain preferred embodiments of the invention will be more clearly described with reference to the following drawings. In the drawings, like reference numerals are used to describe elements which may be present in one or more of the different embodiments of the invention. It is also to be understood that certain features which may be depicted in one embodiment of the invention, may likewise be included in a further embodiment of the invention even though such is not specifically depicted in a drawing figure. For example, a cover film or other cover means which spans across the open end of the cavity may be present in any embodiment of the invention. Similarly, a release means, such as a release film and/or release material may be present according to any embodiment of the invention and indeed, both may be concurrently present according to certain embodiments of the invention although such is not specifically illustrated in any of the following drawing figures.

Figure 2:
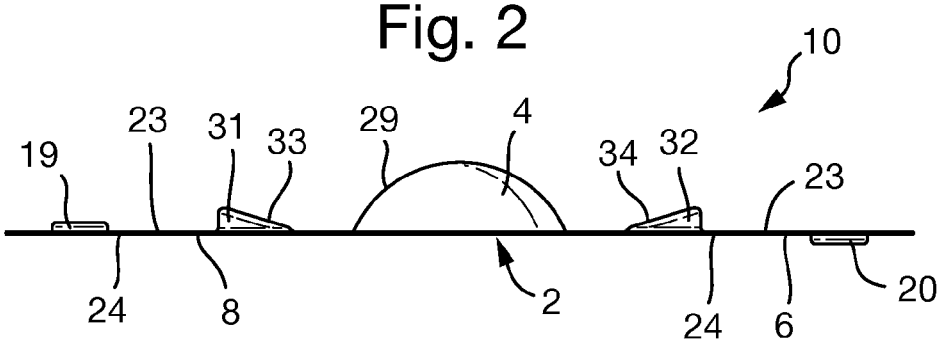
FIG. 2 depicts the embodiment of FIG. 1 in an unfolded, generally planar configuration.
Figure 3:
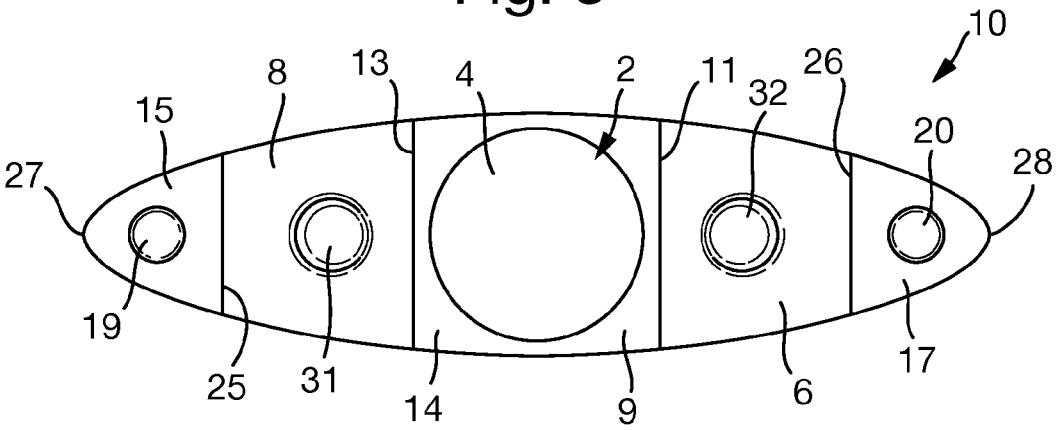
FIG. 3 depicts a view of the embodiment of FIG. 1.
Figure 4:
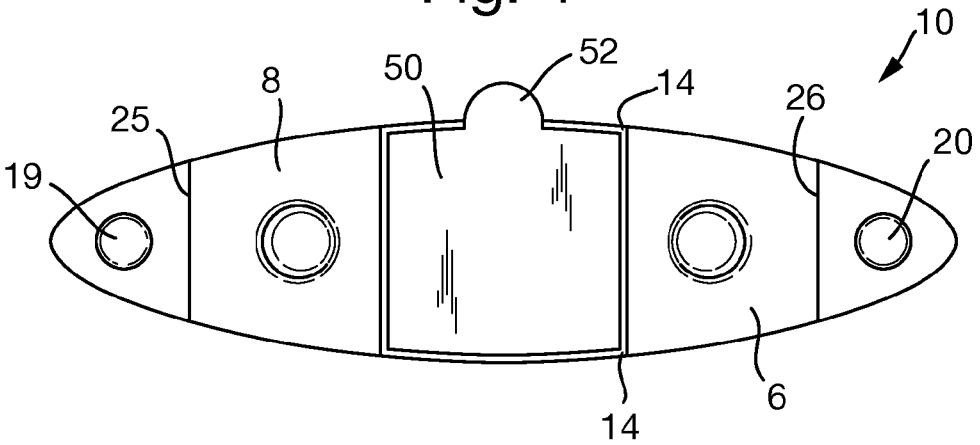
FIG. 4 depicts a further view of the embodiment of FIG. 1, and further illustrates a cover film.

FIG. 1 discloses a preferred embodiment of a single use, foldable dispenser adapted to be used for storing and dispensing a quantity of an adhesive lavatory treatment composition which dispenser has two arms in a folded configuration wherein both of the arms are folded rearwardly of the opening of the cavity, while FIGS. 2 and 3 depict the same dispenser of FIG. 1 in an unfolded, generally planar configuration. FIG. 4 depicts the same dispenser of FIG. 1, which incorporates a cover film 50 (alternately, cover means) spanning across the open end 2 (alternately, opening 2) of the cavity 4. In the embodiment illustrated in FIGS. 1-4, the dispenser 10 includes a pair of foldable arms 6,8 which are flexibly or hingedly affixed or depend from a part of the base 9. Such attachment of the foldable arms 6,8 may be in accordance with any means or construction; here is illustrated that each of the foldable arms 6,8 depend from the base 9 via hinges or hinge lines 11, 13 which may be integrally formed parts of the dispenser 10. As is most easily understood from FIGS. 2-4, in a first configuration both of the foldable arms 6,8 extend outwardly from the base 9 such that the foldable arms 6,8 are essentially or generally coplanar with the face 14 of the base 9. In this manner, an "unfolded" configuration of the dispenser 10 can be provided. The dispenser 10 may assume a further second configuration, wherein at least one, and here both of the foldable arms 6,8 are folded rearwardly of the base 9 and cavity 4 so that at least a portion of each of the arms extends above and/or behind the cavity 4, as is readily understood with reference to FIG. 1. As is seen therefrom, the two rearwardly folded arms 6,8 contact each other, and at least a distal part 15, 17 of each arm 6,8 come into an interfacial laminar contact. As is illustrated in FIG. 1, each arm 6,8 forms an interlocking contact therebetween by virtue of one or more interlocking means which may be provided with the dispenser 10, and/or which are incorporated into the construction of one or both of the arms 6,8. In the depicted embodiment, interlocking means are provided by virtue of a plug 19 which extends out rearwardly from a rear surface 23 of a part of the arm 8, more specifically from a distal part 15 thereof, which plug 19 forms a cooperating friction or interference fit with recess 20 which extends forwardly from a front surface 24 of a part of the arm 6, more specifically from a distal part 17 thereof, such that when arms 6, 8 are folded into configuration depicted on FIG. 1, the plug 19 enters the recess 20 and is retained by means of an interference or friction fit. This configuration may be further facilitated by a pair of secondary hinges or hinge lines 25, 26 which may be integrally formed parts of the respective arms 6,8 of the dispenser 10, and which are located between the hinges or hinge lines 11, 13 and the respective ends 27, 28 of arms 6,8. As is seen from FIG. 1, only part of the arms 6,8 form an interfacial contact in the region of the plug 19 and recess 20.

As is further understood from FIGS. 1-4, the base 9 includes a cavity 4 which is adapted to receive, and to retain a quantity such as a unit dose of a material, e.g., an adhesive lavatory treatment composition. In the depicted embodiment, a generally hemispherical configuration of a cavity 4 is illustrated it is however to be clearly understood that any other configuration for the cavity, including a partitioned cavity, having two or more recesses or parts is clearly contemplated to be within the scope of the instant invention. It is also to be understood that in FIGS. 1-4 the cavity 4, for the sake of convenient illustration, is depicted as being hollow and contains no such material. The cavity 4 nonetheless defines a volume between the face 14 of the base 9 and the cavity wall 29 which is adapted to retain a quantity of such a material. As is clearly visible from these drawing figures, the cavity wall 29 extends rearwardly from a rear surface 23 such that it extends beyond the generally planar surface of the face 14 of the base 9, and of the arms 6, 8 as is clearly depicted on FIG. 2.

In certain embodiments, as is illustrated on the present embodiment of FIGS. 1-4, the device 10 may optionally further include one or more, here two, compression means 31, 32 which are configured and/or adapted to provide a contact surface between the respective compression means 31, 32 and at least a part of the cavity wall 29. In preferred embodiments, when the device 10 assumes a configuration of FIG. 1, the compression means 31, 32 may aid in providing a compressive force which bears against the cavity wall 29 which may facilitate the release of any composition contained within the cavity 9 such that it exits outwardly via the open end 2 of the cavity 4, when distal parts 15, 17 of each arm 6,8 are grasped by a user's fingers and moved together to assume a configuration as illustrated in FIG. 1. In the illustrated embodiment, a compression means 31, 32 is integrally formed within sections of the arms 6, 8 and extend outwardly from a rear surface 23 of a part of each arm 6,8 and includes a sloped flat face 33, 34 which is angled downwardly in the direction of the cavity wall 29 and in the direction of the base 9. Advantageously, the dimensions of each of the compression means 31, 32 and the angle of the sloped flat face 33, 34 are such that when the device 10 is folded to assume the configuration as depicted on FIG. 1, that at least a part of each of the compression means 31, 32 and preferably, at least a part of the sloped flat face 33, 34 of each compression means 31, 32 comes into contact with it the cavity wall 29 rearwardly of both the base 9 and the open end 2 of the cavity.

FIG. 4 illustrates the presence of a cover film 50 (alternately a cover means) which spans across the open end of the cavity and is removed therefrom prior to dispensing any material contained within the cavity 4. As is understood from a review of the figure, the cover film 50 is removably affixed to part of the face 14 of the base 9 and covers the open end (not visible) of the cavity. Prior to the dispensing of any composition which may be (or is) contained within the cavity 4, a part of the cover film, e.g. an extending tab 52, may be grasped by a user (such as between two fingers, such as a thumb and index finger) and pulled away from the base 9 such that the open end 2 of the cavity 4 is exposed, which concurrently also exposes the contents of the cavity, and permits the treatment composition to be dispensed from the dispenser 10 via said open end 2 (or opening 2). Such a cover film 50 may be attached, such as by suitable adhesive between at least a part of the cover film 50 and one or more parts of the base 9, such that it can be removed in the manner as described herein.

Except for the cover film 50 which is a discrete and separable element of the depicted embodiment of the dispensing device 10, advantageously the dispensing device 10 is formed from a single material, preferably a moldable sheet-like material which can be appropriately configured to assume a configuration and/or to function as described herein. The cover film 50 (or cover means) is advantageously a flexible material, such as a flexible synthetic polymeric film or a metal foil or metalized film which can be adhered to, and conveniently peeled away from the dispensing device 10 by a consumer just prior to the dispensing of a quantity (e.g. unit mass, unit, unit dose) of a composition (e.g, adhesive composition, adhesive lavatory treatment composition) onto a surface such as a part of a lavatory appliance (e.g., toilet bowl, bidet) or any other surface to which the composition may be dispensed and preferably adhered. The cover film 50 (or cover means 50) may also be formed of a stiff or rigid material such as a plate or cap which also may be adhered to, or at least partially inserted within the cavity 4, e.g. such that a part of the cover means 50 extends into the cavity 4 in the proximity of the opening 2, such by forming an interference fit or friction fit between parts of the cover means 50 and part of the cavity 4 or other part or parts of the dispensing device 10.

Figure 5:
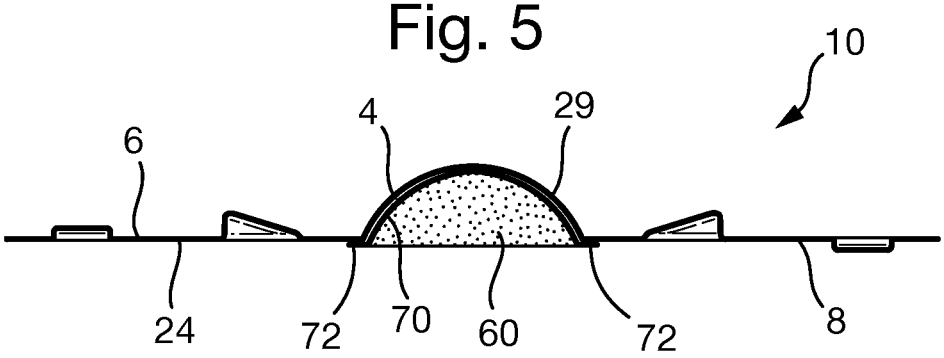
FIG. 5 depicts a further embodiment of a dispensing device according to the present invention.
Figure 6:
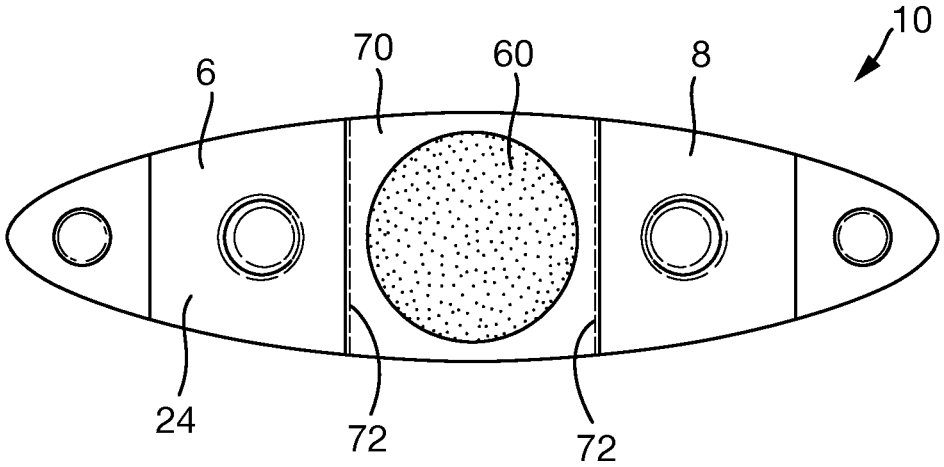
FIG. 6 depicts a further view of the embodiment of FIG. 5.
Figure 7:
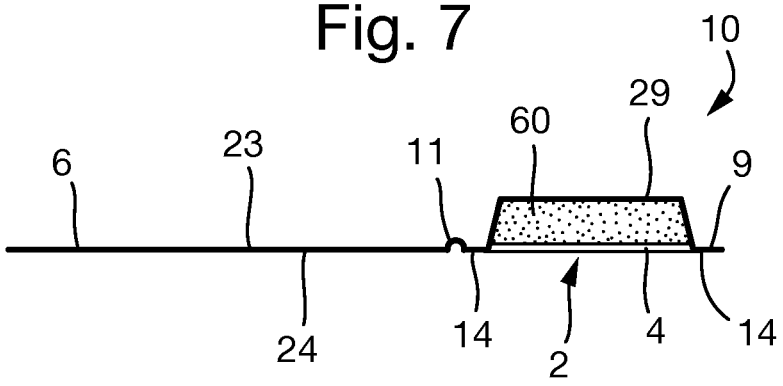
FIG. 7 depicts a yet further embodiment of a dispensing device according to the present invention.
Figure 8:
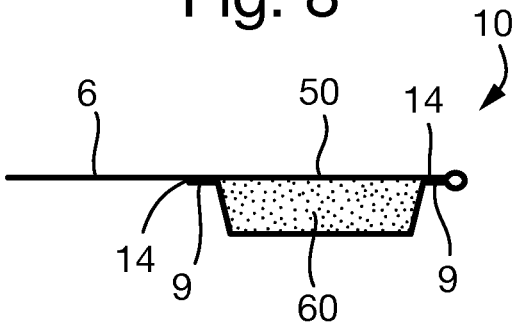
FIG. 8 depicts a further view of the embodiment of FIG. 7.
Figure 9:
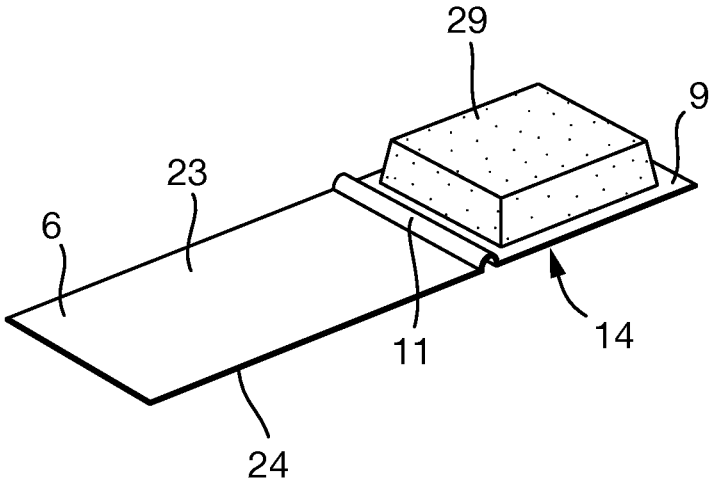
FIG. 9 depicts a further view of the embodiment of FIG. 7.

FIGS. 5 and 6 illustrate a further embodiment of a dispensing device according to the present invention, which is substantially similar to the embodiment discussed with reference to FIGS. 1-4. In this further embodiment, the dispensing device differs only in that (a) it includes a release film 70 which is in part affixed to, or adhered to a part of the base 9, or cavity 4, and which extends into the interior of the cavity 4 such that it is in interfacial contact with at least part of, preferably most of, the cavity wall 29 and separates the cavity wall 29 from (b) an adhesive treatment composition 60 contained within the cavity 4. It is particularly preferred that the release film 70 is only partially adhered to parts of the cavity wall 29 and/or the base 4 (or other parts of the dispenser 10) such that it remains flexible, in such a manner that when the treatment composition is released from the dispensing device 10 via the open end 2 of the cavity 4, at least a part of the release film 70 extends outwardly from the cavity 4, and remains attached to the treatment compositions. As the user withdraws the dispensing device away from the surface to which the treatment composition has been applied, the release film 70 separates from the applied treatment composition but remains adhered to the dispensing device 10. In the embodiment depicted on FIGS. 5 and 6, the release film 70 is adhered only along two bonding points 72, depicted as dotted lines on opposite sides of the open end 2 of the cavity 4; is be understood that the release film 70 is bonded at these bonding points 72 at the face 14 of the base 9, but otherwise remains flexible and unbonded to other points of the dispensing device 10. It is to be further understood that in certain preferred embodiments the release film 70 is adhered or otherwise attached to only one part of the dispensing device. It is also be understood that the release film 70 is of sufficient dimensions such that it extends into the cavity 4 where it can assume a position as depicted in the cross-sectional view provided by FIG. 5.

As can now be better understood in conjunction with FIGS. 5 and 6, the release film 70 act as a barrier layer between the adhesive treatment composition (e.g, adhesive lavatory treatment composition) and the cavity wall 29. Advantageously, the adhesive characteristics or strength of the adhesive treatment composition to the release film is generally substantially lower or poorer than the adhesive characteristics or strength of the adhesive treatment composition to the surface to which the adhesive treatment composition is intended to be applied, e.g., a ceramic surface, a surface of a lavatory appliance, the interior of a toilet bowl, bidet, shower stall, tiled or ceramic surface, such that when a user (e.g. a consumer) of the dispensing device positions the adhesive treatment composition against said surface, and optionally but preferably also applies some pressure against the cavity wall 29, the adhesive treatment composition adheres to the said surface, and when the user withdraws the dispensing device the release film 70 gently peels away from the now adhered adhesive treatment composition. Any material which can be formed into such a release film 70 and which has such adhesive characteristics or strength is described herein can be utilized, and selection of such material can be determined by a skilled artisan, once the specific chemical composition and the nature of the adhesive treatment composition is established or selected, and such an adhesive composition is specified for use with a dispensing device as described herein. Any number of such materials may be used. By way of nonlimiting example, preferred and exemplary materials useful for forming the release film 70 (as well as at least part of the cover means 50) include those which exhibit good oxygen barrier properties (preferably exhibiting an oxygen barrier property of not more than about 4000 $cm^3$ $\mu m/m^2$ d kPa, preferably not more than about 2000 $cm^3$ $\mu m/m^2$ d kPa (at 23° C. and 95% relative humidity), include metal foils, metalized polymeric films, a coated paper or other coated fibrous material (e.g, a silicone coated paper) but especially preferably are thin flexible films formed from synthetic polymers which may be based on one or more comonomers, and minor amount of other materials such as colorants, plasticizers, etc. which may included in their compositions in order to supply a desired technical or aesthetic feature to the synthetic polymer films. Non-limiting examples of such films include those based on or comprising one or more of: polycarbonates, polyacrylics such as poly(methylmethacrylate), polyalkylene terephthalates such as poly(ethylene terephthalate) and poly(butylene terephthalate), polyvinyl alcohols, polyesters, polyamides (such as Nylon materials) and especially polyolefins such high density polyethylene (HDPE), low density polyethylene (LDPE) and linear low density polyethylene (LLDPE), each of which polymer films may also optionally minor amounts of other materials such as colorants, plasticizers, etc. as well. A particularly preferred polymer film includes films based on polyvinylidine chloride (PVDC) which may include one or more additional monomers, polymer films based on polyethylene which may include one or more additional monomers as well (such as "SARAN" film, ex. S.C. Johnson & Son Co.) which are amongst preferred materials for the release film 70. The release film may also be a laminate of two or more different materials. The thickness of the release film 70 may vary widely, and is in part a function of the relative stiffness of the material used to form the release film 70; again, most advantageously a flexible sheet-like film is preferred for use. Where the cover film 50 (cover means 50) is a more rigid or stiff element such as a plate, or molded element, such may be formed of any material such as a synthetic polymeric material included those discussed above, a metal, a metalized polymeric material, a coated paper or other coated fibrous material (e.g, a silicone coated paper, a wax coated paper, a paper having a layer of a synthetic polymer) as well as laminates containing one or more of the above, by any suitable means such as by stamping, folding as well as molding (thermoplastic or thermosetting) molding processes to form a suitably dimensioned cover means 50 for a dispensing device 10 of a desired or suitable configuration.

As an alternative to the release film 70 disclosed and discussed with reference to FIGS. 5 and 6, the same embodiment may instead be provided with a release material which is present within and/or extends into the cavity 4, which release film forms a barrier between the contents of the cavity of the dispenser and the dispenser itself, here the cavity wall 29. Such a release material may be any article or composition which may be applied to the cavity wall 29 and which forms at least a partial barrier layer, but preferably a total barrier layer between the adhesive composition contained by the dispenser 10 within the cavity 4, and the cavity wall 29. Advantageously the adhesive characteristics or strength of the adhesive composition to the release material is generally substantially lower or poorer than the adhesive characteristics or strength of the adhesive treatment composition to the surface to which the adhesive treatment composition is intended to be applied, e.g., a ceramic surface, a surface of a lavatory appliance, the interior of a toilet bowl, bidet, shower stall, tiled or ceramic surface, such that when a user (e.g. a consumer) of the dispensing device positions the exposed adhesive treatment composition against said surface, and optionally but preferably also applies some pressure against the cavity wall 29, the adhesive treatment composition adheres to the said surface, such that when the user withdraws the dispensing device most (>75%, preferably >90%) of the adhesive composition exits the device 10. Any material which can be formed into such a release material, having such adhesive characteristics or strength is described herein and which can be applied to the device 10 and preferably within the cavity 4 can be utilized. The selection of such material can be determined by a skilled artisan, once the specific chemical composition and the nature of the adhesive treatment composition is established or selected, and such an adhesive composition is specified for use with a dispensing device as described herein.

In certain preferred embodiments, the release material 70 is a fluid or liquid material, such as a pourable, flowable or sprayable material which exhibits such adhesive characteristics or strength as described above. The release material in such a physical form is preferred for use as such can be conveniently applied such as by coating, spraying, dipping, brushing, a quantity of the release material onto a part of parts of the device 10. It is to be understood that it is not in all aspects necessary that the entire interior of the cavity 4 need be coated by the release material as some instances, only a partial coverage of the cavity wall 29 may be required and indeed preferable. For instance, it may be desired that one or more small areas of the cavity wall 29 be uncoated by the release material, and thereby allow for physical interfacial contact between the adhesive treatment composition and a portion of the uncoated cavity wall 29 thereby allowing one or more points of adhesion between the mass of the adhesive treatment composition and the cavity wall 29 which may aid in its retention within the cavity 4. Alternatively, the entire cavity wall 29 may be fully coated by the release material 70 to form a complete barrier between the cavity 4 and the adhesive treatment composition contained within.

Non-limiting examples of such release materials include virtually all materials whose adhesive composition to the release material is generally substantially lower or poorer than the adhesive characteristics or strength of the adhesive treatment composition to the surface to which the adhesive treatment composition is intended to, or to which the adhesive treatment compositions are ultimately applied. Such include hydrophobic liquids such as glycerine and paraffin oil, as well as petroleum distillates and/or petroleum products, and also paraffinic oils usually based on n-alkanes, naphthenic oils including those based on cycloalkanes, aromatic oils such as those based on aromatic hydrocarbons, mineral oil, as well as technical grade mixtures of hydrocarbons may be used as or in the organic solvent. Examples of the latter include paraffinic hydrocarbons including both linear and branched paraffinic hydrocarbons; the former are commercially available as NORPAR solvents (ex. ExxonMobil Corp.) while the latter are available as ISOPAR solvents (ex. ExxonMobil Corp.) Further useful release materials include one or more oxyalkylenated compounds, which are may be liquids or pasty at room temperature (20° C.). Exemplary suitable oxyalkylenated compounds include polyethylene glycols, polyethylene glycol esters and/or polypropylene glycol esters, polyethylene glycol ethers and/or polypropylene glycol ethers, alkoxylated acyl derivatives, ethoxylated acyl polyol derivatives, oxyalkylenated (especially) oxyethylenated triesters of glycerol and of fatty acids, and mixtures thereof, each having a minimum molecular weight of about 100, preferably about 200, and especially preferably of at least about 250. Non-limiting examples of suitable polyethylene glycols which may be used in the composition of the invention include ethylene oxide polycondensates having a number of ethylene oxide (EO) units of greater than 5, and preferably greater than about 20. Non-limiting examples of such polyethylene glycols include polyethylene glycol comprising 75 EO (CTFA name: PEG-75), and polyethylene glycol comprising 150 EO (CTFA name: PEG-150) and polyethylene glycol comprising 7,000 EO (CTFA name: PEG-7M).

FIGS. 7-10 depict a further embodiment of a dispensing device 10 according to the invention. The depicted dispensing device 10 includes a cavity 4, and a single foldable arm 6 which may be hinged around the base 9. In the embodiment illustrated, the cavity 4 contains a quantity of an adhesive treatment composition 60, which cavity 4 also includes an open end 2. In an initial configuration illustrated on FIG. 8, the arm 6 is folded forwardly such that at least part of the arm 6 is used to form a cover means 50 overlapping the open end 2 of the cavity 4 of the base 9, which seals the adhesive treatment composition from the ambient environment. In a second configuration as is depicted on FIGS. 7, 9 and 10, the arm 6 is folded away from the open end 2 of the cavity of the base 9, preferably such that the arm 6 is generally coplanar with the face 14 of the base 9, as is more clearly visible from these figures.

Figure 10:
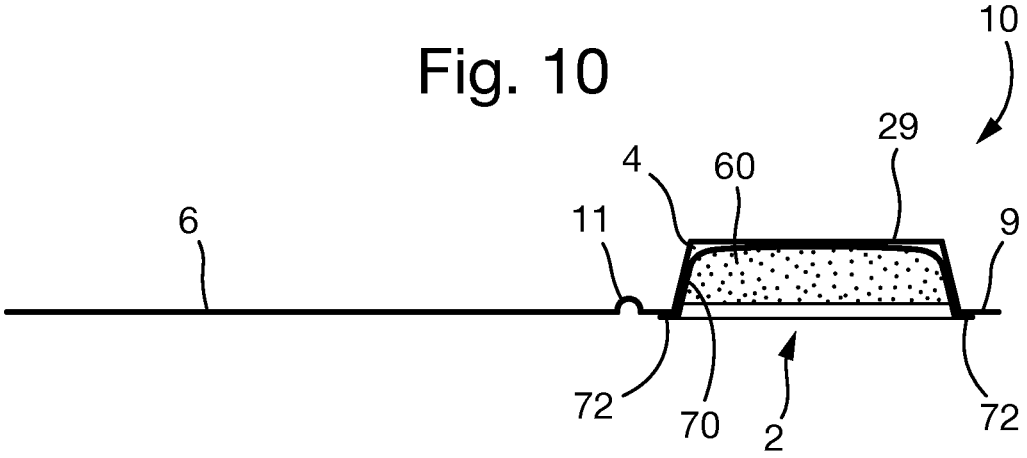
FIG. 10 depicts a further view of the embodiment of FIG. 7.
Figure 11:
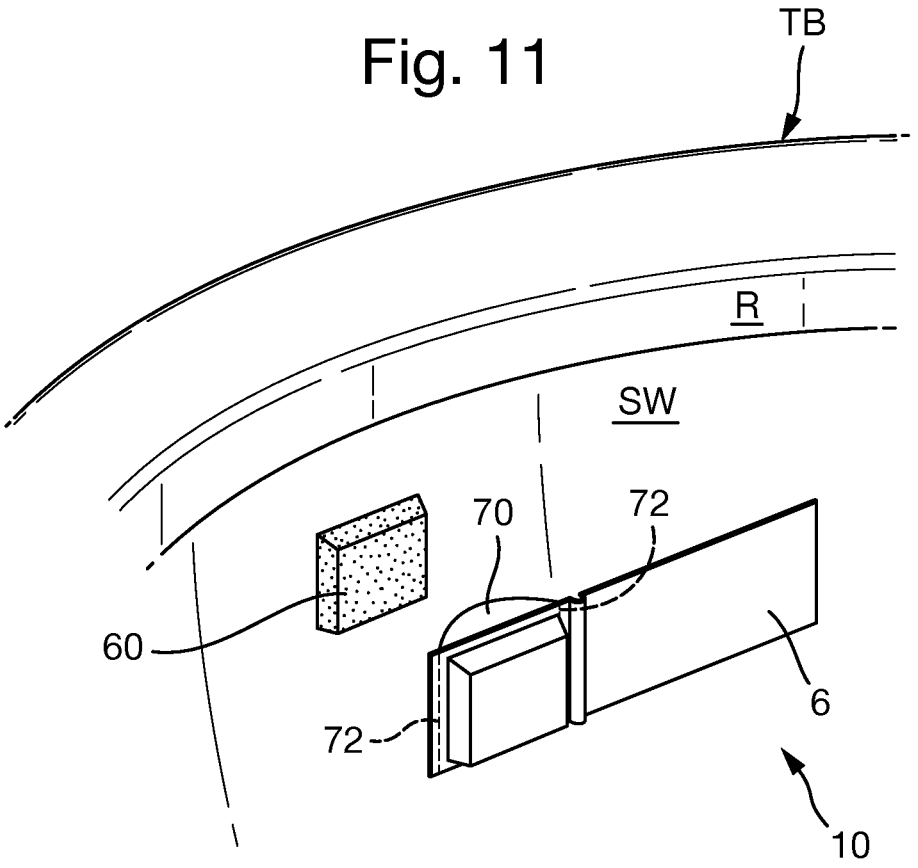
FIG. 11 depicts a configuration of the dispensing device of FIGS. 7-10 immediately after a quantity of an adhesive treatment composition has been adhered to the sidewall "SW" of the lavatory appliance.

FIG. 10 depicts an embodiments of this further dispensing device 10, wherein the dispensing device 10 further includes a release film 70 which is affixed to only parts of the base 9 and extends into the interior of the cavity 4 such that it is in interfacial contact with at least part of, preferably most of the cavity wall 29. The release film 70 separates the cavity wall 29 from the adhesive treatment composition 60 contained within the cavity 4. Similarly to the embodiment discussed with reference to FIGS. 5 and 6, the release film 70 is only partially adhered to parts of the cavity wall 29 and/or the base 4 (or other parts of the dispenser 10) such that it remains flexible, so that when the treatment composition is released from the dispensing device 10 via the open end 2 of the cavity 4, at least a part of the release film 70 extends outwardly from the cavity 4. Such is illustrated with reference to FIG. 11, which depicts a configuration of the dispensing device 10 according to FIGS. 7-11 immediately after a quantity of an adhesive treatment composition 60 has been adhered to the sidewall "SW" of the lavatory appliance, here a toilet bowl "TB" at a point below the rim "R" such that the adhesive treatment composition 60 is in the path of flush water released into the toilet bowl from beneath the rim. In the embodiment depicted on FIGS. 5 and 6, the release film 70 is adhered only along two bonding points 72, depicted as dotted lines on opposite sides of the open end 2 of the cavity 4. It is to be understood that the release film 70 is bonded at these bonding points 72 at the face 14 of the base 9, but otherwise remains flexible and unbonded to other points of the dispensing device 10. It is also understood that the release film 70 is of sufficient dimensions such that it extends into the cavity 4 where it can assume a position as depicted in the cross-sectional view provided by FIG. 10. As is most clearly understood with reference to FIG. 11, as the dispensing device 10 is withdrawn away from the treatment composition which has been adhered to the sidewall SW of the toilet bowl TB, the release film 70 is of sufficient flexibility that while it initially remains in contact with the treatment composition as it is withdrawn from the interior of the cavity 4 and in the figure assumes a "bowed" configuration as it is retained to the face 14 of the base 9 by the bonding points 72 on opposite sides of the cavity 4. As the user further withdraws the dispensing device 10 way from the sidewall SW and the now adhered treatment composition, the release film separates from the now adhered treatment composition 60. Although not illustrated in FIG. 11, it can be readily understood with reference thereto that according to this embodiment of a dispensing device 10, a user or consumer may grip the arm 6 between one or more fingers and the palm of a hand, and place the thumb of the hand behind the cavity wall 29 such that the thumb can exert an amount of compression against this cavity wall 29 and urge the adhesive treatment composition 60 outwardly therefrom and against the surface to which the adhesive treatment composition 60 is adhered, here the sidewall SW of the toilet bowl TB.

Figure 12:
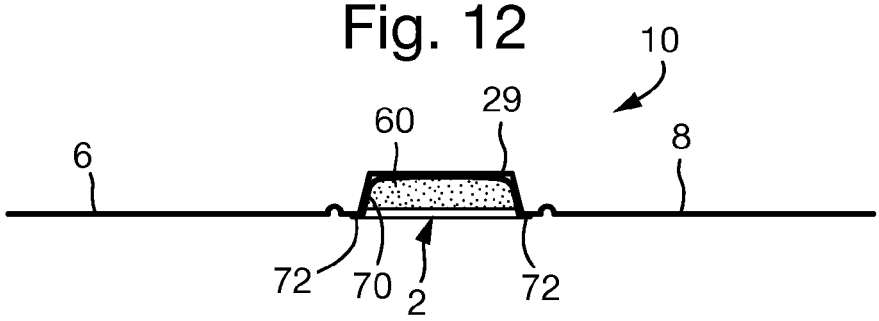
FIG. 12 depicts a still further embodiment of a dispensing device according to the present invention.
Figure 13:
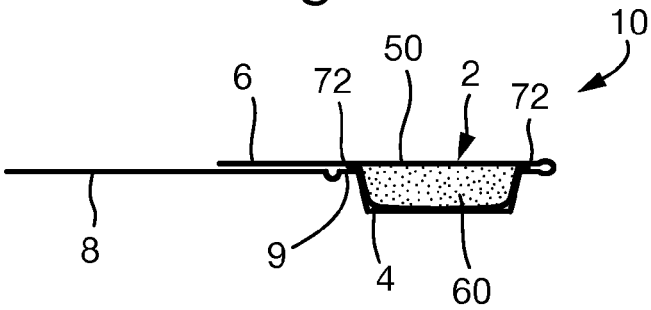
FIG. 13 depicts a further view of the embodiment of FIG. 12 in an alternate configuration.
Figure 14:
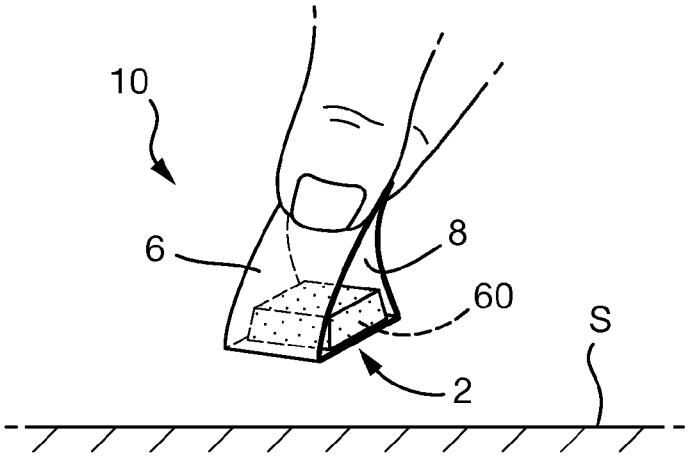
FIG. 14 depicts a still further view of the embodiment of FIG. 12 in an alternate configuration.

FIGS. 12-14 illustrate a still further embodiment of a dispensing device according to the present invention which is similar in many respects to the embodiment corresponding to FIGS. 7-11, which differs substantially only in that two arms 6, 8 are included, and that in a first configuration illustrated on FIG. 13. arm 6 is folded to overlap both a part of arm 8 and comes into interfacial contact there with, and concurrently also form a cover means 50 overlapping the open end 2 of the cavity 4 of the base 9, which seals the adhesive treatment composition 60 from the ambient environment. Although not specifically illustrated, it is nonetheless to be understood that in the first configuration, a suitable adhesive may be present between the overlapping parts of the arms 6 and 8, and/or at least in the region of the cover means which overlaps the open end 2 of the cavity 4 of the base 9, which adhesive may retain the arms 6, 8 of the device 10 in the configuration depicted in that figure. In a second configuration as is depicted on FIG. 12, arm 6 is folded away from arm 8 as well as from the open end 2 of the cavity of the base 9, preferably such that the each of arms 6, 8 are generally coplanar with the face 14 of the base 9, as is more clearly visible from these figures. In such a configuration, the adhesive treatment composition is exposed to the ambient environment via the open end 2 of the base 9. Thereafter, as is shown with reference to FIG. 14, the two arms 6, 8 may be folded rearwardly behind the cavity 4, and grasped between two fingers of a hand, and the exposed adhesive treatment composition can be directed towards a surface "S" to which it is to be applied, and adhered.

It is to be understood that in any of the foregoing embodiments, only a single bonding point, or more than two bonding points 72 between the release film 70 and the face 14 of the base 9 (or any other part of the dispensing device) may be provided.

Figure 15:
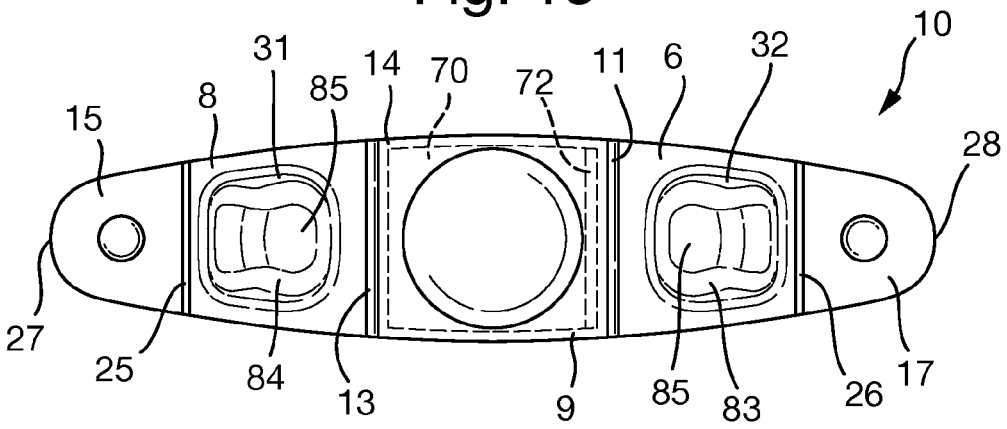
FIG. 15 depicts another alternative embodiment of a dispensing device according to the present invention.
Figure 16:
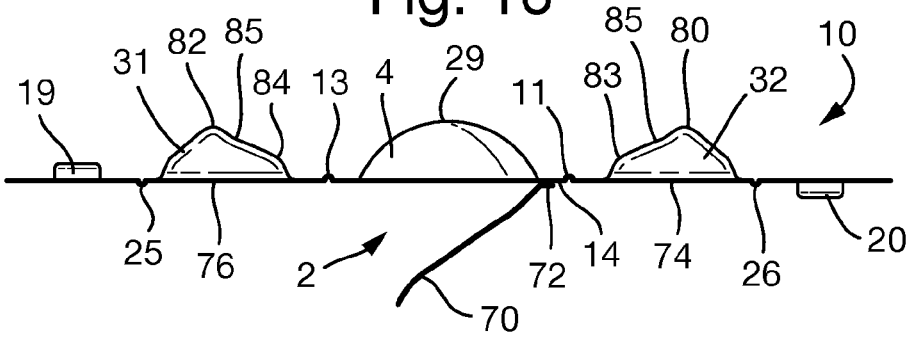
FIG. 16 depicts a further view of the embodiment according to FIG. 15.
Figure 17:
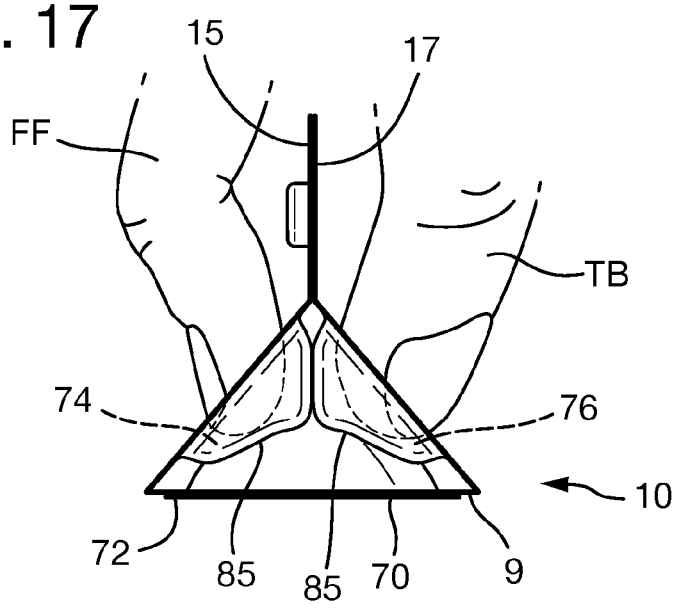
FIG. 17 depicts a further view of the embodiment according to FIG. 15 in a folded configuration.

A further embodiment of a dispenser is illustrated on FIGS. 15-17, which in many respects it similar to the embodiment disclosed and discussed with reference to FIGS. 1-6. In the embodiment of FIGS. 15-17, the dispenser 10 is illustrated in an unfolded, generally planar configuration in a top plan view in FIG. 15, and in a side or elevation view in FIG. 16, while in FIG. 17 the dispenser is in a folded configuration. For ease of illustration in these figures, the dispenser 10 is shown having a cavity 4 which is hollow and contains no material.

As illustrated the dispenser 10 includes a pair of foldable arms 6,8 which are flexibly or hingedly affixed or depend from a part of the base 9 via hinges or hinge lines 11, 13 which are integrally formed parts of the dispenser 10. Each of the foldable arms 6, 8 include a at least a distal part 15, 17 which comes into contact when the dispenser assumes a folded configuration as depicted on FIG. 17. The distal parts 15, 17 form an interlocking contact by virtue of one or more interlocking means, here a plug 19 which extends out rearwardly from a rear surface 23 of a part of the arm 8, more specifically from a distal part 15 thereof, which plug 19 forms a cooperating friction or interference fit with recess 20 which extends forwardly from a front surface 24 of a part of the arm 6. In the configuration of FIG. 17, the plug 19 enters the recess 20 and is retained by means of an interference or friction fit. This configuration is facilitated by a pair of secondary hinges or hinge lines 25, 26 which are integrally formed parts of the respective arms 6,8 of the dispenser 10, and which are located between the hinges or hinge lines 11, 13 and the respective ends 27, 28 of arms 6,8. As is understood from FIG. 17, only part of the arms 6,8 form an interfacial contact in the region of the plug 19 and recess 20.

As further depicted on FIGS. 15-17, the base 9 of the dispenser 10 includes a cavity 4 which is adapted to receive a unit dose of a material, e.g., an adhesive lavatory treatment composition. Cavity wall 29 extends rearwardly from a rear surface 23 such that it extends beyond the generally planar surface of the face 14 of the base 9, and of the arms 6, 8. The dispenser 10 further includes a pair of compression means 31, 32 which are configured and/or adapted to provide a contact surface between the each of the compression means 31, 32 and at least a part of the cavity wall 29. In preferred embodiments, when the device 10 assumes a configuration of FIG. 17, the compression means 31, 32 may aid in providing a compressive force which bears against the cavity wall 29 which may facilitate the release of any composition contained within the cavity 9 such that it exits outwardly via the open end 2 of the cavity 4, when distal parts 15, 17 of each arm 6,8 are grasped by a user's fingers and moved together to assume a configuration as illustrated in FIG. 1. In such a folded configuration, the generally bowl shape configuration of the compression means 31, 32 also provides for convenient placement of a fingertip of a user's hand within respective fingertip concavities 74, 76 of the compressive means 31, 32 at or proximate to the base 80, 82 of each compression means 31, 32. In such a preferred embodiment as illustrated on FIGS. 15-17 the exterior face 83, 84 of each compression means 31, 32 includes a face region 85 which has a configuration which complements that part of the cavity wall 29 with which it comes into contact. Preferably the face region 85 is coincident with, or is proximate to the face 83, 84 of each compression means 31, 32. Thus, when the folded dispenser 10 is grasped by a user, such as between a thumb "TB" and forefinger "FF", the tips of each of these fingers is within the of each of the respective fingertip concavities 74, 76 of the compressive means 31, 32, and the face region 85 of each of the compressive means 31, 32 is urged against a respective part of the cavity wall 29 with which parts of each of the compressive means 31, 32 comes into contact. As in FIG. 15-17, these face region 85 include shallow depressions which complement the curved cavity wall 29, any pressure exerted by a user via the fingertips of the thumb TB and forefinger FF is directly transmitted as a compressive force via the face region 85 and against the that part of the cavity wall 29 with which it comes into contact, which in turn may impart a compressive pressure against any material contained within the cavity 4, inducing its exit via the opening 2.

The embodiment illustrated on FIGS. 15-17 also illustrates a release film 70 is adhered only along only one bonding region 72, depicted as a dotted line on opposite sides of the open end 2 of the cavity 4; is be understood that the release film 70 is bonded at this bonding region 72 at the face 14 of the base 9, but otherwise remains flexible and unbonded to other points of the dispensing device 10. Such is better understood with reference to FIG. 16 which illustrates that the release film 70 is held only at one point (one bonding point, one bonding region) to the base 9 or any other part of the dispensing device 10. Thus, after the adhesive material is delivered from the device 10, the released release film 70 may be suspended in a flag-like manner as depicted. It is also be understood that the release film 70 is of sufficient dimensions such that it extends into the cavity 4 where it forms a barrier layer between any adhesive material within the cavity 4 and the cavity wall 29. Also, while not specifically illustrated on FIGS. 15-20 it is clearly contemplated that a cover film 50 (or, cover means 50) may also be included in the dispenser 10, e.g, as illustrated on FIG. 4.

Figure 18:
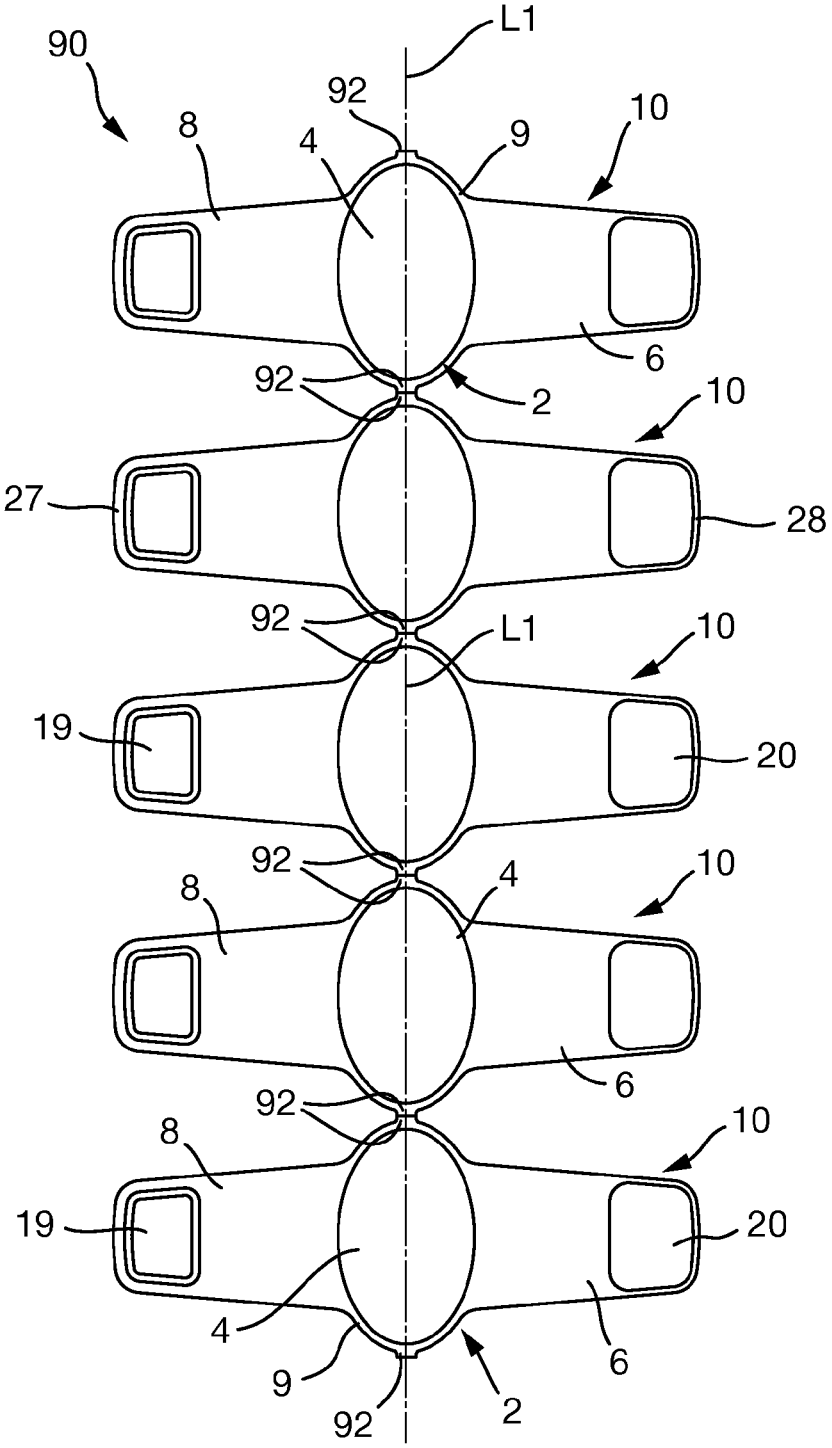
FIG. 18 depicts an array of dispensing devices.

FIG. 18 illustrates an array 90 of dispensers 10, each of which includes a cavity 4 which is adapted to receive a unit dose of a material, e.g., an adhesive lavatory treatment composition, Each of the dispensers 10 is removably affixed or connected to an adjacent dispenser 10 by a separable connector means, which is the present embodiment is a perforated or frangible connector part 92 which retains adjacent dispensers 10 in a fixed position until one adjacent dispenser 10 is separated from a next adjacent dispenser 10 by separating the connector means, e.g, by tearing, folding, bending, pulling or other suitable action. Each of the individual dispensers 10 illustrated on FIG. 18 are similar in most respects to the dispenser described with reference to FIGS. 1-6, but in this illustrated embodiment excludes Each dispenser 10 of the array 90 is essentially identical, and each includes a cavity 4 adapted to or containing a quantity of an adhesive treatment composition, an open end 2 (or opening 2) in a base 9 which allows for the dispensing of the said composition from the dispenser 10, a pair of foldable arms 6,8 which are flexibly or hingedly affixed or depend from a part of the base 9, a plug 19 and a recess 20. Additionally each of the dispensers 10 includes a separable connector part 92 which connects to at least one adjacent dispenser 10. While not shown it is to be understood that one or more of the dispensers 10 may further include compression means such as the compression means 31, 32 of FIGS. 1-6, and/or a cover film 50 (alternately a cover means) which spans across the open end of the cavity and is removed therefrom prior to dispensing any material contained within the cavity 4 such as in FIG. 4, and/or a release film 70 which is in part affixed to, or adhered to a part of the base 9, or cavity 4, and which extends into the interior of the cavity 4 such that it is in interfacial contact with at least part of, preferably most of, the cavity wall 29 and separates the cavity wall 29 from (b) an adhesive treatment composition 60 contained within the cavity 4, such as depicted on FIGS. 5 and 6, and 15-17.

In an embodiment as depicted on FIG. 18, such an array 90 advantageously provides a vendible form of the dispensers 10 of the invention which provides a highly visible yet compact retail display, whereby one or of the individual dispensers 10 can be separated from the array 90 as desired by an ultimate purchaser of the dispenser(s) 10. The array 90 is particularly well suited as a hanging display.

The array 90 of a plurality of dispensers 10 is also technically advantageous as during a manufacturing process, a plurality of empty dispensers 10 may first be formed and by virtue of the connector parts 92, and thereafter each of the cavities 4 filled in a simultaneous or sequential process. For example wherein an array of an integer number "n" of individual dispensers 10 is formed, such is frequently in a generally planar configuration and by virtue of the connector means, the relative placement of the empty cavities 4 is fixed, which is advantageously in an adjacent and/or linear arrangement as illustrated on FIG. 18. Such placement thus facilitates the filling of adjacent or sequential arrays from one filling station having one nozzle in which case the array 90 is moved in a linear fashion whereby an empty cavity 4 is filled, and then the nozzle or the array 90 is moved in a linear direction and the next sequential empty cavity 4 of the next dispenser 10 is filled. Alternatively wherein a generally planar sheet of individual dispensers 10 is formed as an array 90, the array may be provided to a filling station which has a plurality of filling nozzles configured to preset positions which correspond to the configuration of the empty cavities 4 of the array 90. In such a manner, the preformed array 90 of empty dispensers 10 may be conveniently simultaneously filled by operating the filling station to simultaneously deliver the adhesive composition from a plurality of nozzles at the same time. In the foregoing process, in the array 90, the number "n" of individual dispensers 10 is advantageously in the range of 2 to about 80. preferably from about 2 to about 60. In an alternative process, a the array 90 of a plurality of dispensers 10 are formed on a roll or spool, with adjacent empty dispensers 10 attached by one or more intermediate connector means. In the embodiment show, the connector means 92 extend from parts of the base 9 of each dispenser 10, but it is to be understood that the connector means may be positioned on any part of the dispenser 10, e.g, at parts of the base 4 and/or part of the arms 6, 8 thereof. Where such an array 90 is configured so that the placement of adjacent cavities 4 are colinear, (as indicated by representative dashed center line "L1" on FIG. 18) such provides for the convenient subsequent filling of the adjacent cavities 4 as the spool or roll may be unrolled, and directed in a linear direction under one or more filling nozzles which may be placed in a linear arrangement as well and spaced in a suitable configuration to correspond to that of the empty cavities such that empty cavities 4 are positioned under or adjacent to an empty nozzle(s) and filled. The foregoing processes provide non-limiting examples of advantageous production processes of arrays 90 of individual dispensers 10. The embodiment of the array 90 is considered to illustrate a "single linear array" as a single series of adjacent empty dispensers 10 are attached by one or more intermediate connector means and wherein a single line or row of cavities 4 are colinear along a single center line L1.

Figure 19:
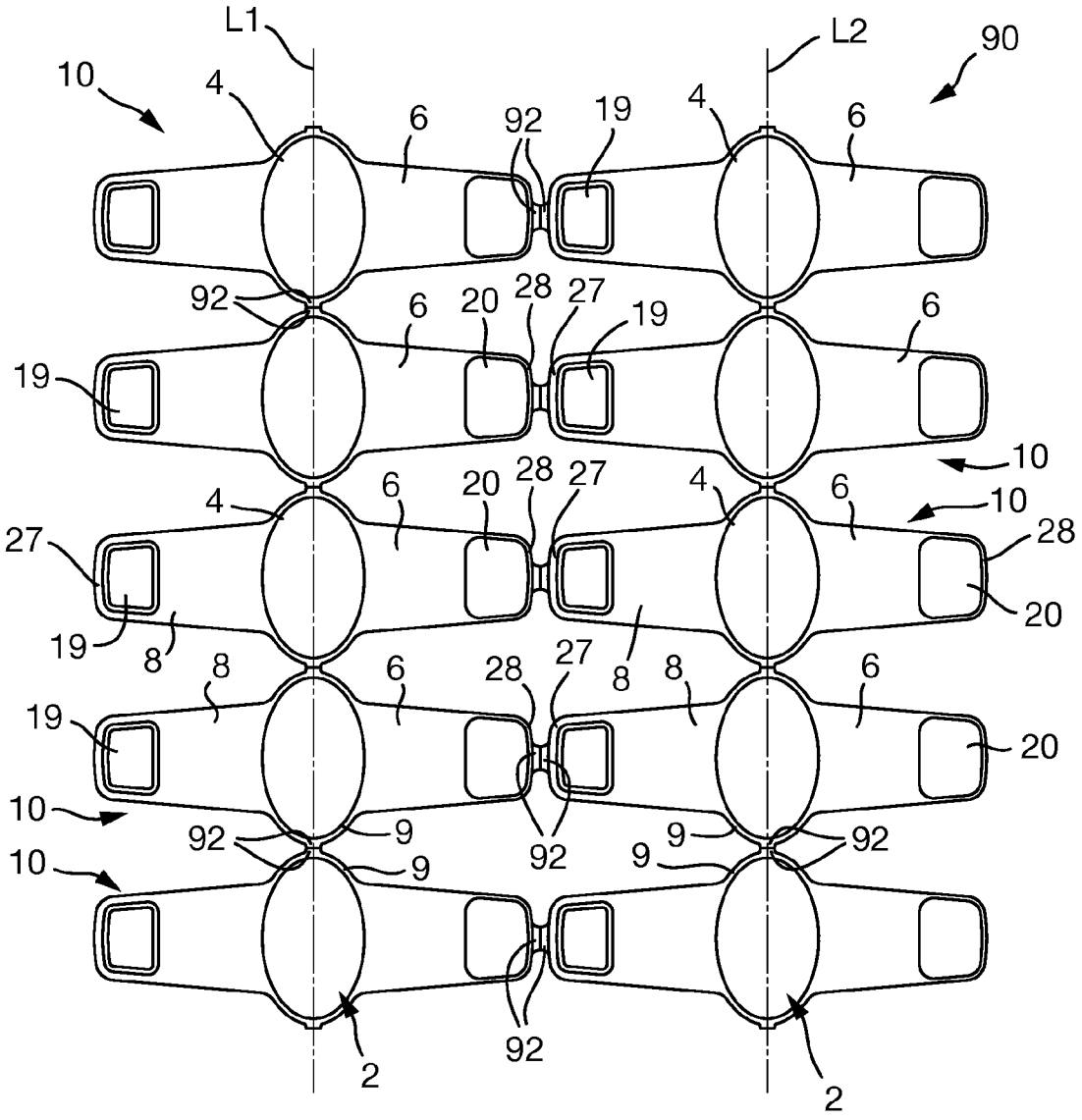
FIG. 19 depicts a further array of dispensing devices.

FIG. 19 depicts an embodiment of an array 90, here in the form of a "dual linear array" wherein the array includes at least two rows of parallel individual dispensers 10 such that the cavities 4 present are positioned along two parallel lines, a first center line "L1" and a second center line "L2". Advantageously as illustrated the first center line and the second center lines are parallel with respect to each other, which thereby establishes the configuration and relative placement of the cavities 4 of adjacent dispensers 10. Here the individual dispensers 10 are essentially the same as described with respect to those of FIG. 18, but comprise further connector means 92 which in addition to the base 4, also extend from parts of the arms 6,8 and more specifically from the ends 27, 28 thereof. The embodiment of the array 90 is considered to illustrate a "dual linear array" as two series of adjacent empty dispensers 10 are attached by one or more intermediate connector means and wherein a two lines or rows of cavities 4 are colinear and in this embodiment, parallel with respect to one another.

It is to be clearly understood that parts and elements disclosed in one of the foregoing configuration or otherwise depicted upon or discussed with reference to one or more of the drawing figures may be utilized in any other embodiment of the invention.

The invention claimed is:

1. A dispenser comprising:

a base;

a cavity having an opening, disposed within said base;

an adhesive lavatory treatment composition disposed within said cavity;

one or more foldable arms hingedly attached to said base;

wherein in an initial configuration said one or more arms extend outwardly from and generally coplanar with said base and in a second subsequent configuration said one or more arms are folded rearwardly of said base so that at least a portion of said one or more arms extends behind said opening of said cavity.

2. The dispenser according to claim 1, wherein said dispenser includes a release material which extends into said cavity and forms a barrier between the adhesive lavatory treatment composition and the cavity.

3. The dispenser according to claim 2, wherein at least a portion of said release material is affixed to said dispenser.

4. The dispenser according to claim 2, wherein said release material is a release film.

5. The dispenser according to claim 1, wherein said dispenser includes a cover means which spans the opening of said cavity and may be removed therefrom prior to dispensing the adhesive lavatory treatment composition from the cavity.

6. A dispenser comprising:

a base;

a cavity having an opening disposed within said base;

an adhesive lavatory treatment composition to be dispensed disposed within the cavity;

one or more foldable arms hingedly attached to said base;

wherein in an initial configuration said one or more arms extend outwardly from and generally coplanar with said base and in a second subsequent configuration said one or more arms are folded forwardly of said base so that at least a portion of said one or more arms forms a cover means over the opening of said cavity.

7. The dispenser according to claim 1 wherein said dispenser comprises two rearwardly folded arms wherein at least one of said arms contains an interlocking means which permits said arms to engage and interlock with each other to provide a handle means.

8. The dispenser according to claim 1, wherein said dispenser is of a single-use type and not refilled with a further amount of an adhesive lavatory treatment composition to be dispensed.

* * * * *